US009549242B2

(12) United States Patent
Silver et al.

(10) Patent No.: US 9,549,242 B2
(45) Date of Patent: Jan. 17, 2017

(54) ACOUSTIC FILTER

(71) Applicant: Bose Corporation, Framingham, MA (US)

(72) Inventors: Jason D. Silver, Framingham, MA (US); John H. Wendell, Boston, MA (US)

(73) Assignee: Bose Corporation, Framingham, MA (US)

( * ) Notice: Subject to any disclaimer, the term of this patent is extended or adjusted under 35 U.S.C. 154(b) by 32 days.

(21) Appl. No.: 14/865,374

(22) Filed: Sep. 25, 2015

(65) Prior Publication Data

US 2016/0014499 A1 Jan. 14, 2016

Related U.S. Application Data

(63) Continuation of application No. 13/534,517, filed on Jun. 27, 2012, now Pat. No. 9,173,018.

(51) Int. Cl.
*H04R 1/28* (2006.01)
*H04R 1/30* (2006.01)

(52) U.S. Cl.
CPC ..... *H04R 1/2803* (2013.01); *H04R 1/288* (2013.01); *H04R 1/30* (2013.01); *H04R 2400/13* (2013.01)

(58) Field of Classification Search
CPC ..... H04R 1/28
USPC ..... 381/346, 351
See application file for complete search history.

(56) References Cited

U.S. PATENT DOCUMENTS 4,157,741 A * 6/1979 Goldwater ..... H04R 1/30 181/156
5,189,706 A * 2/1993 Saeki ..... H04R 1/2826 181/155

* cited by examiner

*Primary Examiner* — Matthew Eason
*Assistant Examiner* — Phan Le

(57) ABSTRACT

A loudspeaker comprising includes an enclosure, a driver element located within the enclosure and including a cone diaphragm, a first cavity defined by a first cavity wall and the cone diaphragm, the first cavity extending from the cone diaphragm and having a first opening which has an area less than an area of the cone diaphragm, an exit element extending from the first opening of the first cavity and acoustically coupling the first cavity to an environment outside of the enclosure, a second cavity, defined by a second cavity wall within the enclosure extending from a second opening in the first cavity, and an acoustic element in the second opening acoustically coupling the second cavity to the first cavity. The second cavity is not otherwise acoustically coupled to the environment outside of the enclosure.

14 Claims, 19 Drawing Sheets

1100

1500

ACOUSTIC FILTER

BACKGROUND

This invention relates to loudspeaker design.

The frequency response of a loudspeaker characterizes the output spectrum of the loudspeaker in response to a stimulus. The frequency response is often analyzed in terms of a magnitude response and a phase response. In general, it is desirable for a loudspeaker to have as flat of a magnitude response as possible, meaning that no one frequency is significantly amplified or attenuated relative to the other frequencies.

SUMMARY

In an aspect, in general, a loudspeaker element includes an enclosure, a cone diaphragm of a driver element located within the enclosure, a first cavity wall extending from the cone diaphragm of the driver element to a throat opening which has an area less than an area of the cone diaphragm and forming a first cavity within the enclosure, an exit element extending from the throat opening to an environment outside of the enclosure, and an impedance compensation element extending from the first cavity wall, the impedance compensation element including a second cavity wall which forms a second cavity within the enclosure and a resistance element separating the second cavity from the first cavity.

Aspects may include one or more of the following features.

The impedance compensation element may extend from the first cavity wall at a location which is in close proximity to the cone diaphragm of the driver element. The resistance element may be an acoustic resistance element in the form of a screen material. The resistance element may be an acoustic resistance element in the form of a foam material.

The impedance compensation element may include a resonating compensation element. The resonating compensation element may include a first lumped element resonating structure. The first lumped element resonating structure may include the second cavity, the resistance element, a third cavity wall forming a third cavity within the enclosure, and a passive radiator element separating the third cavity from the second cavity. The resistance element may be an acoustic resistance element in the form of a screen material.

The first lumped element resonating structure may include the second cavity, the acoustic resistance element, a third cavity wall forming a third cavity within the enclosure, and a porting element connecting the second cavity to the third cavity. The resistance element may be an acoustic resistance element in the form of a screen material. The resistance element may be an acoustic resistance element in the form of a foam material.

The first lumped element resonating structure may include a passive radiator element and the resistance element may be a mechanical resistance element associated with the passive radiator element.

The resonating compensation element may include a plurality of lumped element resonating structures. The plurality of lumped element resonating structures may include a plurality of cavity walls forming a plurality of cavities within the enclosure, one or more acoustic resistance elements separating one or more of the plurality of cavities from the first cavity, and a plurality of passive radiator elements separating at least some of the plurality of cavities from each other.

The plurality of lumped element resonating structures may include a plurality of cavity walls forming a plurality of cavities within the enclosure, one or more acoustic resistance elements separating one or more of the plurality of cavities from the first cavity, and a plurality of porting elements connecting at least some of the plurality of cavities to each other.

The resonating compensation element may include a distributed resonating structure. The second cavity may be elongated. The second cavity may be tapered. The resistance element may be an acoustic resistance element in the form of a screen material. The resistance element may be an acoustic resistance element in the form of a foam material.

The loudspeaker element may include a phase plug located within the first cavity. The plurality of lumped element resonating structures may include a plurality of cavity walls forming a plurality of cavities within the enclosure, one or more acoustic resistance elements separating one or more of the plurality of cavities from the first cavity, one or more porting elements connecting at least some of the plurality of cavities to each other, and one or more passive radiator elements separating at least some of the plurality of cavities from each other.

Other features and advantages of the invention are apparent from the following description, and from the claims.

DESCRIPTION

Figure 1:
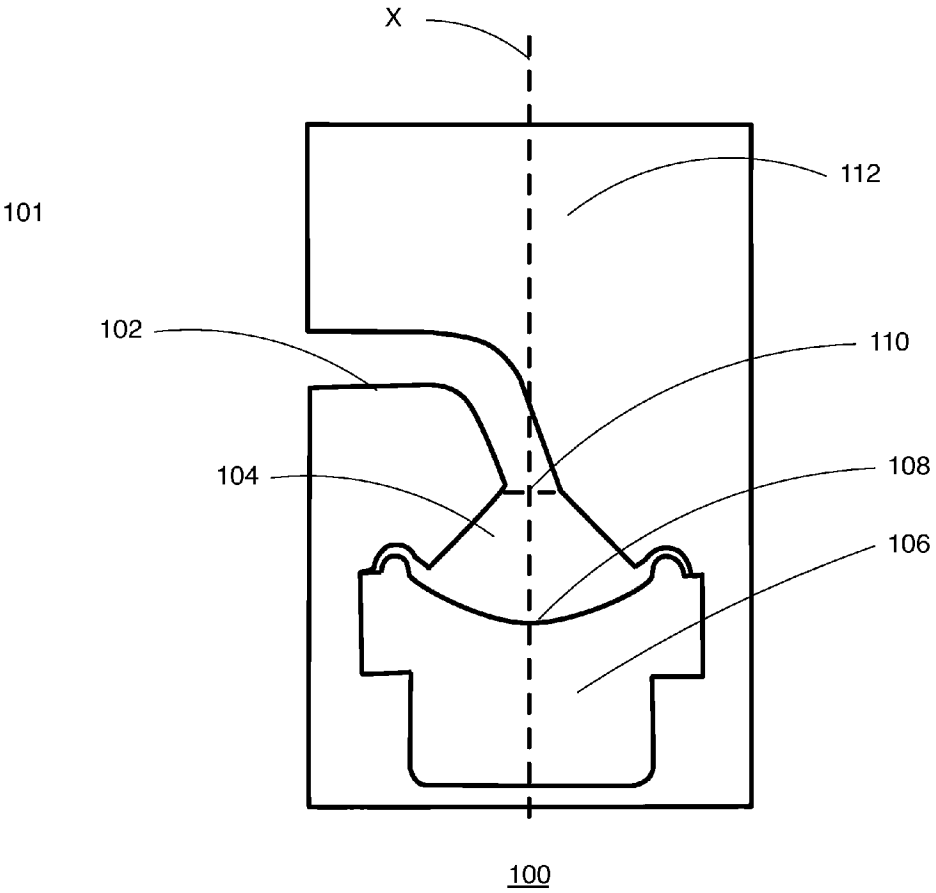
FIG. 1 is a cross section of a compression loudspeaker assembly.

Referring to FIG. 1, in one embodiment, a compression loudspeaker assembly 100 includes a driver element 106 which is housed in an enclosure 112. The driver element 106 transduces an electrical signal into sound pressure waves. The sound pressure waves emanate through enclosure 112 via a cavity 104, past a throat 110 into an exit element 102 before exiting to an outside environment 101. The throat 110 represents a transition from the cavity 104 to the exit element 102. The loudspeaker assembly 100 is a compression loudspeaker assembly because it uses compression to improve the coupling efficiency between the driver element 106 and the air in the outside environment 101. In general, the driver element 106 is loaded by a structure that introduces compression by confining the output of the driver element 106 to a region with smaller cross sectional area than a diaphragm area of the driver element 106.

The throat 110 has an area that is smaller than the area of the cone diaphragm 108 of the driver element 106 with the ratio of the area of the cone diaphragm 108 to the area of the throat 110 defining the compression ratio. In general, higher compression ratios yield higher efficiency when the area of the exit (mouth) is large enough so that the radiation impedance into the outside environment is resistive. In some examples, the compression ratio is configured such that the cross-sectional area of the exit element 102 is small, making it easier to duct the exit element 102 out of the enclosure 112.

When the area of the mouth is large enough so that the radiation impedance into the outside environment is resistive, and when the throat 110 has a smaller area than the cone diaphragm 108 mouth, a high pressure is developed in the cavity 104 for a relatively small amount of displacement of the cone diaphragm 108 driver element 106. Therefore the sound waves are of high pressure and low displacement at the throat 110 of the loudspeaker assembly 100.

The sound pressure waves travel from the throat 110 and through the exit element 102 to the outside environment 101. A loudspeaker design such as that which is shown in FIG. 1 and described above can result in a relatively high efficiency loudspeaker. In some examples, the exit element 102 is tapered (not shown) and the sound waves gradually decompress and decrease in displacement as they travel through the exit element 102.

In general, it is desirable for the frequency response of any loudspeaker assembly to be as flat as possible. However, a number of factors inherent to the design of the compression loudspeaker assemblies can cause undesirable frequency response characteristics. Some examples of undesirable frequency response characteristics are frequency response roll off at high frequencies, peaks in the frequency response due to resonances and notches in the frequency response due to cancellations. In some examples, notches (i.e., nulls) in the frequency response can be present if a phase plug (described below) is not used. In other examples, notches in the frequency response can be present if the phase plug is not positioned correctly. In other examples, if the diaphragm of the transducer does not behave like a rigid piston at high frequencies, additional peaks and notches can appear in the frequency response due to a phenomenon referred to as 'cone-breakup.' Similarly, if the mechanical suspension of the transducer (e.g., the spider and surround) does not behave like an ideal spring, but has its own resonances, then there can be additional peaks and notches in the frequency response. Similarly, if the back air volume of the driver does not behave like an ideal spring, standing waves can be generated in the back air volume which can create peaks and notches in the frequency response.

Low Pass Filter Effect

With reference to FIG. 1, in some examples, the cavity 104 includes a relatively large volume of air which acts as an acoustic impedance, imparting a low-pass filter characteristic (i.e., attenuating high frequencies) to the frequency response of the loudspeaker.

Resonances in the Loudspeaker Assembly Cavity and Exit Element

In some examples, the geometry of the cavity 104 and the exit element 102 causes peaks, and notches at certain frequencies in the frequency response of the loudspeaker assembly 100.

For example, if the design of the loudspeaker assembly is not symmetric around an axis (i.e., X), non-axisymmetric cavity modes can exist within the cavity 104 when the cavity 104 is excited by the driver element 106. In general, non-axisymmetric cavity modes (i.e., resonances) have their pressure patterns dictated by the geometry of the cavity and commonly lead to peaks and notches at high frequencies of the frequency response of the loudspeaker assembly 100.

Furthermore, the geometry of the cavity 104 can cause axisymmetric standing wave modes to exist within the cavity 104 when the cavity 104 is excited by the driver element 106. In general, axisymmetric standing wave modes have pressure patterns that look like concentric rings centered about the X axis. Axisymmetric standing wave modes can cause peaks and/or notches at one or more frequencies in the frequency response of the loudspeaker assembly 100. In some examples, such peaks and notches arise due to one cavity mode dominating (i.e., peaks) or multiple cavity mode response adding deconstructively (i.e., notches).

Additionally, the exit element 102 of the type shown in FIG. 1 is in the form of a horn or a waveguide extending from the throat 110 and opening into the outside environment 101. In some examples, the geometry of the exit element 102 causes resonances between the cavity 104 and the outlet of the exit element 102. In general, the length and shape of the exit element 102 and the size and shape of the cavity volume 104 controls the number of resonances as well as the spacing of the resonances in the frequency domain and the Q factor of the resonances depends on the amount of loss (i.e., resistance) at resonance.

In some examples, resonances with a high Q factor make equalizing a loudspeaker assembly difficult. For example, a loudspeaker can be equalized by filtering the electrical input signal to attenuate certain frequencies where resonances occur and amplifying certain other frequencies where notches occur in the loudspeaker frequency response. However, environmental factors such as temperature and humidity can cause the frequencies of the resonances and notches to shift. The mismatch between the shifted system frequency response and the fixed frequency response with the compensating equalization applied can result in attenuation at frequencies other than those where resonances occur and an amplification at frequencies other than those where notches occur which may make the overall frequency response of the system plus equalization worse than if no equalization were applied.

Acoustic Filters

In the embodiments described below, a number of different structures are included in loudspeaker assemblies similar to the loudspeaker assembly 100 of FIG. 1 for the purpose of impedance compensation. The combination of the different structures is herein referred to as an acoustic filter.

Figure 2:
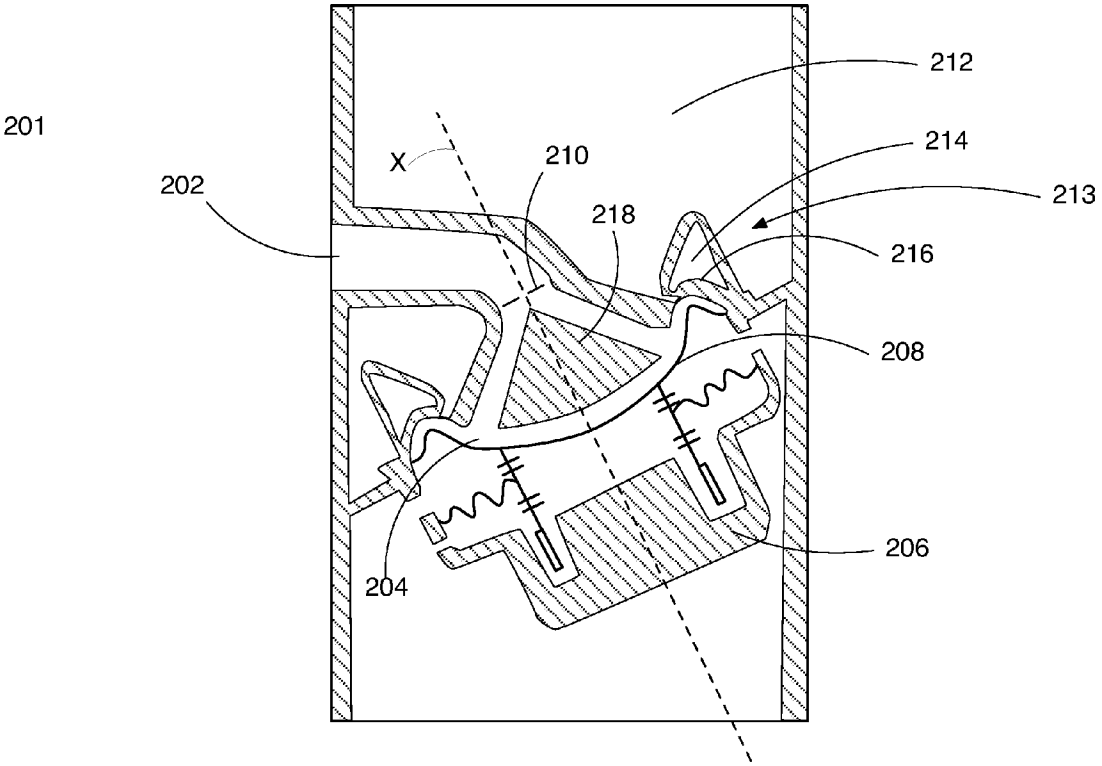
FIG. 2 is a cross sectional view of a compression loudspeaker assembly including a first impedance compensation element.

Referring to FIG. 2, a cross sectional view of a second loudspeaker assembly 200 illustrates one way in which the second loudspeaker assembly 200 mitigates the undesirable frequency response characteristics described above using an acoustic filter. In particular, the loudspeaker assembly 200 includes an acoustic filter which includes an axisymmetric phase plug 218, an impedance compensation element 213, a relatively short waveguide 202, and an angled driver 206. In the present embodiment, the impedance compensation element 213 includes an additional volume 214 in the enclosure 212 separated from the cavity 204 by an acoustic resistance 216 (e.g., screen or foam material).

Axisymmetric Phase Plug

The axisymmetric phase plug 218 is a member having a shape generally similar to the shape of the cavity 204 but with a lesser volume than the cavity 204. Due to its shape and volume, the phase plug 218 can be suspended within the cavity 204 of the loudspeaker assembly 200 using thin ribs (not shown). In general, the phase plug 218 is axisymmetric about the center axis, X, of the driver element 206.

The phase plug 218 serves two purposes in mitigating undesirable frequency response characteristics. The first purpose is to reduce the volume of air present in the cavity 204. By reducing the volume of air present in the cavity 204, the cone 208 of the driver element 206 encounters a cavity 204 with greater acoustic impedance (i.e., stiffness). Increasing the acoustic impedance of the cavity 204 encountered by the cone 208 of the driver element 206 mitigates the low-pass filtering effect caused by a large cavity air volume, thereby improving high frequency efficiency of the loudspeaker assembly 200. In some examples, the volume of the cavity 204 is specified such that a given low-pass cutoff frequency is realized.

The second purpose of the phase plug 218 is to reduce unwanted axisymmetric cavity modes by directing sound from the cavity 204 into the waveguide 202.

Since the phase plug 218 is axisymmetric about the center axis, X, of the driver element 206, the excitation of non-axisymmetric cavity modes is avoided.

Exit Element Design

The loudspeaker assembly 200 of FIG. 2 includes a waveguide type exit element 202. The use of such an exit element 202 creates high frequency resonances in the output of the loudspeaker assembly. However, to mitigate the effect of these resonances, the waveguide 202 is shortened relative to the waveguide 102 illustrated in FIG. 1. Shortening of the waveguide 202 causes the first resonance created in by the waveguide 202 to occur at a higher frequency, resulting in fewer audible resonances in the output of the loudspeaker assembly 200.

As was described above, it is desirable to shorten the exit element 202 (e.g., the waveguide), causing the frequency of the first resonance to increase. In some embodiments (e.g., the embodiment shown in FIG. 2), the waveguide 202 is shortened by angling the driver element 206 by 25 degrees.

In other embodiments, the effect of the resonances caused by the waveguide 202 is mitigated by tapering the waveguide 202 such that the area of the opening of the waveguide 202 increases as the waveguide 202 extends away from the throat 210 and towards the outside environment 201.

In some embodiments, the resonances caused by the waveguide 202 are used to boost high frequency efficiency of the loudspeaker assembly. For example, the length of the waveguide 202 can be specified such that a resonance occurs at a particular frequency where high efficiency is desired.

Screen and Volume Impedance Compensation Element

The loudspeaker assembly 200, including the phase plug 218 and the relatively short exit element 202 can produce resonances with undesirably sharp peaks (i.e., having a high Q) in the frequency response of the loudspeaker assembly 200 output.

To mitigate the undesirably sharp peaks in the frequency response, the impedance compensation element 213 is included in the loudspeaker assembly 200. The impedance compensation element 213 includes an acoustic resistance 216 located near the outer edge of the driver element 206 and in between the compression cavity 204 (where the pressure is at a local maximum) and an additional volume 214. In this configuration, the pressure in the compression cavity 204 is large at the resonant frequencies and air flows through the resistive material into the additional volume 214, damping and lowering the Q of the resonance as long as the impedance of the compensation element 213 is dominated by resistance (and not reactance).

The acoustic impedance presented by the impedance compensation element 213 is specified to be dominated by resistance (and not reactance) and less than the acoustic impedance of the combination of the exit element 202 (e.g., the waveguide) and the cavity volume 204 at the frequencies where the resonances occur. This ensures that at the frequencies where the resonances occur, air flows into the additional volume 214 rather than out of the waveguide. Similarly, the acoustic impedance presented by the impedance compensation element 213 is specified to be more than the acoustic impedance of the combination of the exit element 202 (e.g., the waveguide) and the cavity volume 204 at the frequencies where no resonances occur. This ensures that at non-resonant frequencies volume velocity flows into the combination of the exit element 202 and the compression cavity 204 rather than into the additional volume 214. It also ensures that the pressure in the cavity 204 will not be attenuated significantly at non-resonant frequencies.

The acoustic resistance 216 can be made of materials which resist the flow of air (e.g., screen or foam materials). Placing resistive materials as described above serves to damp all resonances generated by the loudspeaker assembly 200.

In some examples, the acoustic resistance 216 and the additional volume 214 can be tuned to achieve a desired result. For example, a simple resistance 216 and resistance cavity volume 214 gives an impedance that is resistive above some break frequency. Below the break frequency, the combined acoustic resistance 216 and the additional volume 214 are reactive and therefore do not significantly affect the Q of the peaks of the power radiated sensitivity, though the resonant frequencies of the peaks may shift (i.e., be lowered). In some examples the break frequency is determined by the following equation:

$$f_break = \frac{1}{2\pi}\frac{1.4\times10^5}{RV_{shunt}}$$

where R is the resistance value of the acoustic resistance 216 and $V_{shunt}$ is the volume of the additional volume 214.

In some examples, the impedance compensation element 213 can be tuned using the following process:

Identify the resonant peaks to be damped.

Make the additional volume 214 as large as possible in a model of the system, compared to other structures present in the model of the system.

Run a simulation which iteratively tries different resistance values for the acoustic resistance 216 to identify which resistance value damps the identified peaks the most.

Reduce the additional volume 214 in small increments, leaving the acoustic resistance 216 unchanged, until the response at the peak with the lowest frequency among the identified peaks starts to depart significantly from the largest possible volume case.

This volume where departure occurs is a good design compromise between the size of the additional volume 214 and the performance of the impedance compensation element 213. Note that the design is not constrained to use this volume.

The determined additional volume 214 and acoustic resistance 216 set the break frequency of the impedance compensation element 213, which is the minimum frequency for which the acoustic resistance 216 will lower the Q of the peaks.

In general, impedance compensation elements (e.g., the impedance compensation element 213 described above) are coupled to the compression cavity 204 of a loudspeaker element and are not coupled to any part of the exit element (e.g., the waveguide 202) of the loudspeaker element. This ensures that the compensation element is exposed to broadband, high pressure sound waves. The compression cavity is coupled to standing waves that may be generated in the waveguide exit structure, and to standing waves present within the compression cavity. The impedance compensation element can only provide compensation if it can affect the system modes and the above-described location of the impedance compensation element ensures that the largest number of system modes possible are affected. In some examples, the impedance compensation element may not couple to non-axisymmetric modes in a system composed of a waveguide and cavity volume, nor to axisymmetric modes existing only in the cavity volume. However, such modes are less important, if present at all.

The impedance compensation element location described above avoids the need to find a specific location along the exit element to locate an impedance compensation element in order to affect a desired mode. The location effectively couples all modes of interest that may exist in the exit structure which allows compensation of more than one mode simultaneously using the same compensation element.

A wide variety of compensation elements can be used to affect modes selectively. The first embodiment of a simple screen and cavity can simultaneously affect a large number of modes and does not require a specific tuning of a compensation element resonance with a mode in the system. The approach is insensitive to shifts in modes. The amount of compensation is tuned by adjusting a value of acoustic resistance, but there is no frequency tuning of resonances required other than setting the minimum frequency at which the compensation element operates.

In other examples, a resonating compensation element is used. In these cases the resonances of the impedance compensation element are tuned to match system resonances. For example, the resonances may be tuned to match a mode (i.e., a standing wave pattern) that exists only in the cavity 204, or a mode that exists in the combination of the exit element and the cavity 204, or both. In some examples, an impedance compensation element with a single lumped element resonance, multiple lumped element resonances, or a distributed element with a series of resonances may be used. The lumped elements may include acoustic elements only (acoustic masses and volumes), or a combination of mechanical and acoustical elements (use of passive radiators with cavities and acoustic masses). In other examples, a resistive element may be used in combination with resonating elements to control the magnitude of the impedance compensation applied.

Because the resonating elements are exposed to the same environment as the rest of the system, environmental shifts in system resonances are reasonably compensated by correlated shifts in the compensation networks.

As mentioned previously, a resistance element (e.g., 216) that forms part of the impedance compensation element (e.g., 213) is directly coupled to the compression cavity (e.g., 204). The various embodiments of impedance compensation elements (to be described in more detail later) include at least one additional cavity. The resistance element is located so that it is placed between the compression cavity and a cavity (e.g., 214) of the impedance compensation element. Any pressure difference between the pressure in the compression cavity and the pressure in the impedance compensation element cavity coupled to the acoustic resistance appears as a pressure drop across the resistance. In most of the embodiments described, the resistance element is an acoustical resistance, and is typically provided by a screen or foam material. However, in one embodiment, the resistance is a mechanical resistance provided by a highly damped (i.e. lossy) surround of a passive radiator device (e.g., FIG. 18, element 1821), where the passive radiator is mounted between the compression cavity and an impedance compensation element cavity. The pressure drop across the acoustical resistance results in flow through the resistance, where the amount of flow is a function of the pressure difference and the acoustical resistance. In the case of the mechanical resistance, the pressure drop across the passive radiator results in a difference in force being applied to each side of the passive radiator. The force difference causes the passive radiator (and thus the surround which is attached to the passive radiator) to move with a velocity, where the velocity is a function of the force difference (driven by the pressure difference) and the mechanical impedance of the passive radiator. In both cases, the pressure difference across the resistance element results in energy being dissipated in the resistance element. Because a pressure difference (or force difference) is generated across the resistive element, the resistive element can potentially dissipate energy over a wide frequency band. That is, if the pressure difference or force difference occurs over a wide frequency band, the resistance configured as described is capable of dissipating significant energy across a wide frequency band, somewhat independent of the wavelengths of sound.

A resistance located between the compression cavity and an impedance compensation element cavity behaves much differently than a system where acoustically absorptive material is simply placed within a cavity. Assuming a cavity behaves as a lumped element, the pressure everywhere within the cavity (because of the lumped element assumption) is the same everywhere. As a result, there is no pressure difference developed across the absorptive material placed within the cavity. Damping in this system is due to the pressure in the cavity only, not a pressure difference. It is well known that it is difficult to obtain pressure based absorption for frequencies where the wavelengths are much larger than the dimensions of the absorption material. As a result, it is difficult to use absorption material placed within a cavity to damp system resonances at frequencies where wavelengths are large compared to the dimensions of the cavity (the absorption material at most has the dimensions of the cavity in which it is placed). The resistance of the embodiments described in the current disclosure are capable of providing damping of resonances across a wide frequency range, whereas simply placing acoustical absorption material within a cavity of a compensation element can only provide damping of resonances at frequencies where the wavelengths are not large compared to the dimensions of the cavity.

Experimental Data

Figure 3:
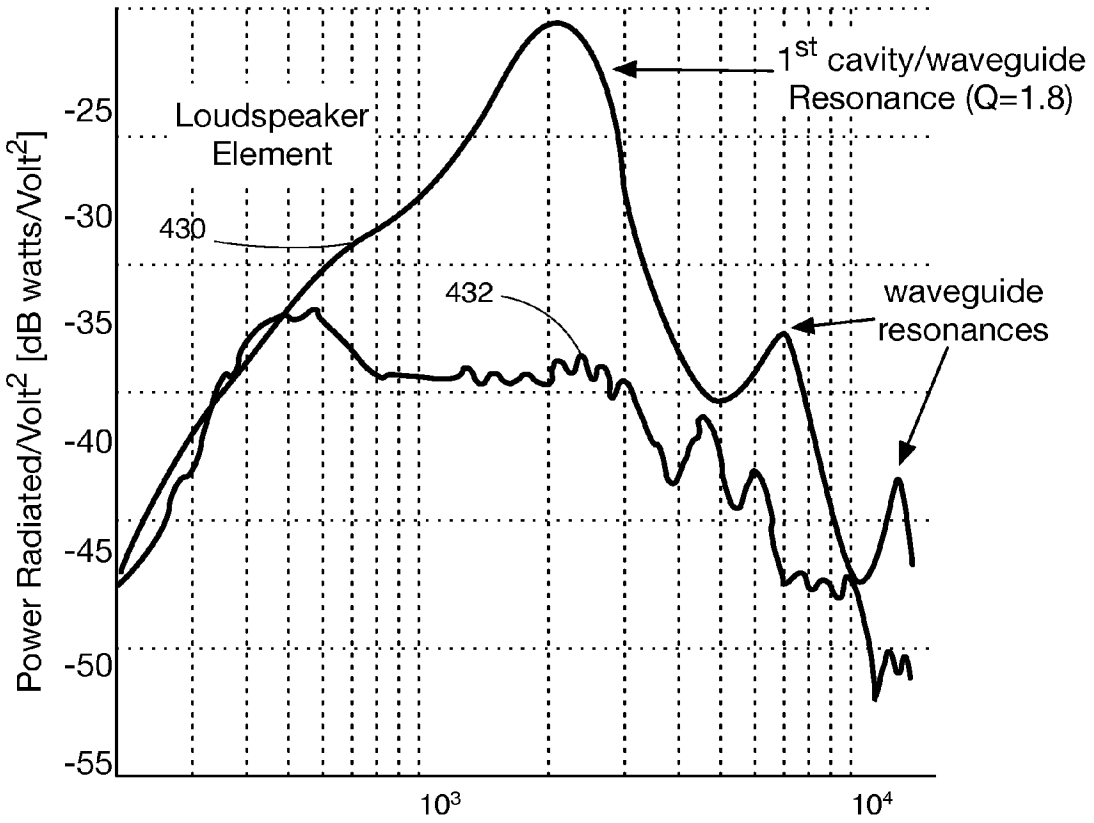
FIG. 3 is a plot of the frequency response of the loudspeaker assembly of FIG. 2.

Referring to FIG. 3, a first frequency response 430 of the loudspeaker assembly 200 of FIG. 2 radiating in free space is illustrated along with a second frequency response 432 of a conventional loudspeaker assembly. While not perfectly smooth, the first frequency response 430 of the loudspeaker assembly 200 is smooth enough to be equalized. While the second frequency response 432 of the loudspeaker assembly is relatively flat in its middle frequency band, the first frequency response 430 loudspeaker assembly 200 of the present application has higher sensitivity in this region. This higher sensitivity means that the loudspeaker assembly 200 of the present application has output to spare, which can be used for more efficient speaker operation or for arraying multiple loudspeaker assemblies 200 to actively steer sound for increased spaciousness.

In practice, an improved frequency response can be obtained by tuning the acoustic impedance of the combination of the acoustic resistance 216 and the additional volume 214 shown in FIG. 2 (henceforth referred to as the screen system). As described below, FIGS. 4-9 illustrate how different configurations of the screen system affect the acoustic power radiated sensitivity and the acoustic impedances of the loudspeaker assembly 200. In general, the loudspeaker assembly used in for the following experiments have a mouth area of 2.52 $cm^2$, a throat area of 1.12 $cm^2$, a cone diaphragm diameter of 2.4 cm, a front cavity volume of 0.56 $cm^3$, and a waveguide length of 45 mm.

Figure 4:
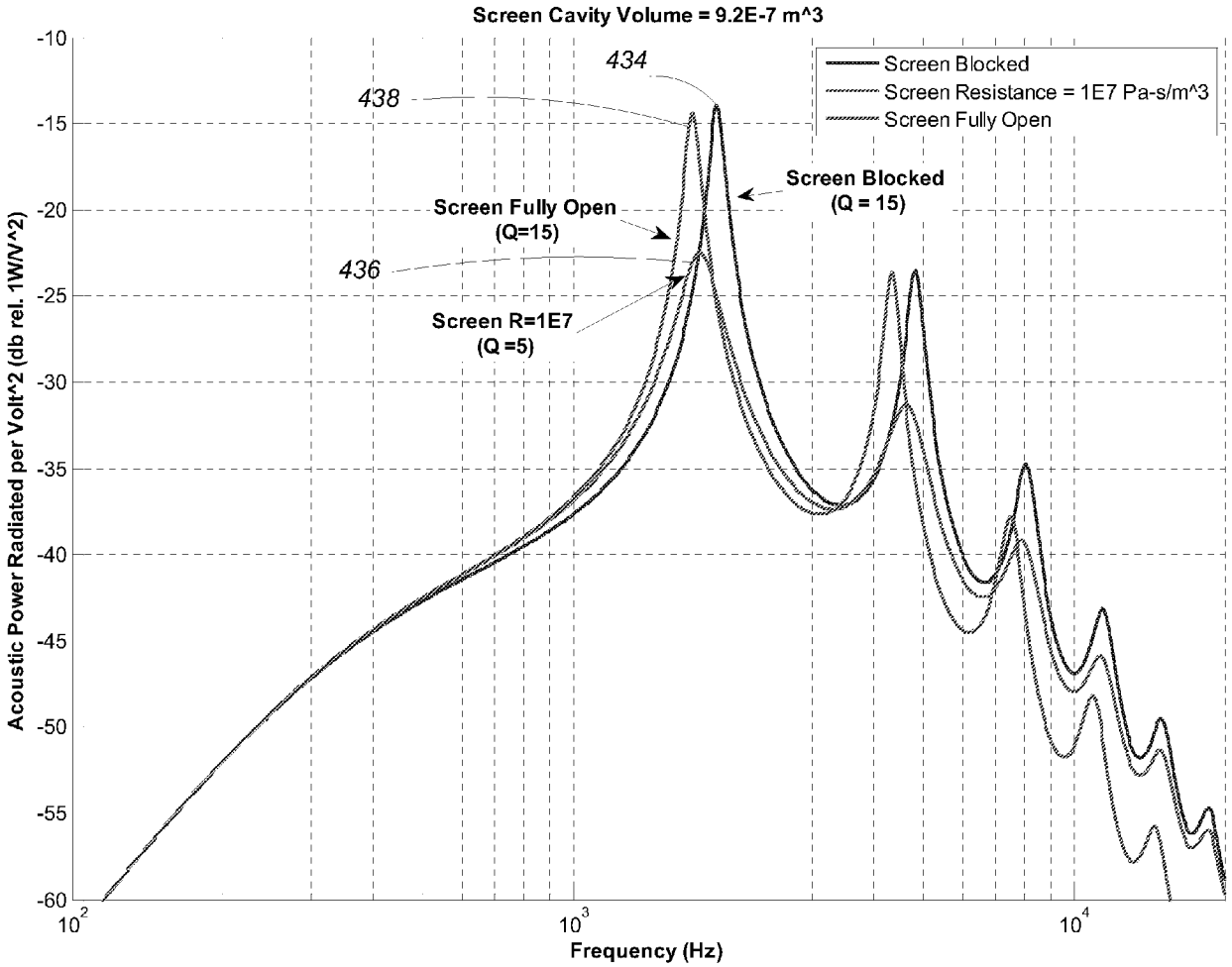
FIG. 4 is a plot of acoustic power radiated sensitivity of the loudspeaker assembly of FIG. 2 as acoustic resistance is varied.
Figure 5:
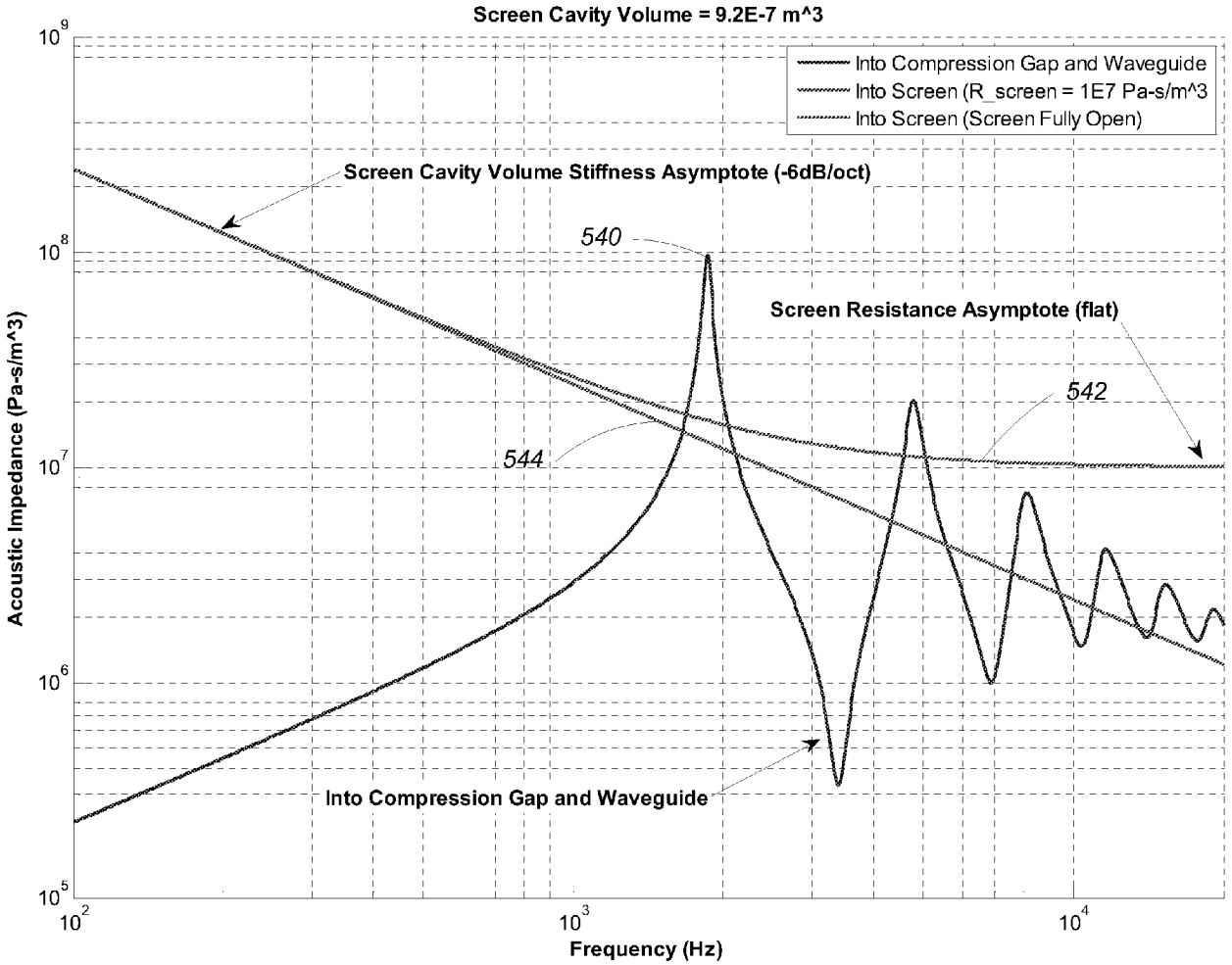
FIG. 5 is a plot of acoustic impedance of the loudspeaker assembly of FIG. 2 as acoustic resistance is varied.

FIGS. 4 and 5 illustrate the results of an experiment where the volume of the additional volume 214 of a loudspeaker assembly 200 is kept at a constant $9.27e^{-7}$ $m^3$ and the acoustic resistance 216 of the loudspeaker assembly 200 is varied.

Referring to FIG. 4, a graph illustrates the acoustic power radiated sensitivity of the loudspeaker assembly 200 as the acoustic resistance 216 is varied. The three curves on the graph correspond to three different values of the acoustic resistance 216. The first curve 434 corresponds to a configuration of the loudspeaker assembly 200 where the resistance of the acoustic resistance 216 is large enough to block any significant movement of air from the compression cavity 204 into the additional volume 214. In this curve 434, strong peaks with a high Q are present at a fundamental resonant frequency and the overtones of the resonant frequency. Valleys in the curve 434 exist at frequencies between the peaks. Note that the overtones are generally higher frequency resonances (i.e., modes) which are not harmonically related to the fundamental resonant frequency.

The second curve 436 corresponds to a configuration of the loudspeaker assembly 200 where the resistance of the acoustic resistance 216 is:

$$1e^7\ Pa{\cdot}s/m^3.$$

Such an acoustic resistance 216 reduces the Q of the peaks shown in the first curve 434 while only minimally reducing the output at the frequencies where the valleys exist.

The third curve 438 corresponds to a configuration of the loudspeaker assembly 200 where the resistance of the acoustic resistance 216 is negligible (i.e., movement of air from the compression cavity 204 into the additional volume 214 in unimpeded). Such a lack of acoustic resistance does not reduce the Q of the peaks shown in the first curve but does result in a considerable reduction in the output at the frequencies where the valleys exist as well as a lowering of the resonant frequencies. This is especially true at high frequencies. Both the shifting of the resonant frequencies and reduction of the output at high frequencies is due to the compression cavity appearing to be larger when no acoustic resistance is present. Such a larger cavity volume increases the low pass filtering effect of the cavity volume on the volume velocity into the waveguide.

Reducing the Q of the peaks while preserving the output level at the valleys is a desirable characteristic. Thus, the second curve 436 of FIG. 4 shows that it is desirable to have an acoustic resistance 216 separating the compression cavity 204 and the additional volume 214.

Referring to FIG. 5, a graph illustrates the acoustic impedances of the screen system as the acoustic resistance 216 is varied.

The first curve 540 in the graph represents the acoustic impedance that is imparted by the compression cavity 204 and the exit element 202. The second curve 542 represents the acoustic impedance imparted by an acoustic resistance 216 with a resistance of:

$$1e^7\ Pa{\cdot}s/m^3.$$

and with a volume behind the screen of $$9.2{\times}10^{-7}\ m^3$$

The third curve 544 represents the acoustic impedance that is imparted by an acoustic resistance 216 which is negligible.

In general, when the acoustic impedance imparted by the screen system is dominated by resistance and is large relative to the acoustic impedance imparted by the compression cavity 204 and the exit element 202, the screen system has negligible impact on the output or performance of the loudspeaker assembly 200.

However, when the acoustic impedance imparted by the screen system is dominated by resistance and is comparable to the acoustic impedance imparted by the compression cavity 204 and the exit element 202, the screen system diverts a sufficient amount of the driver volume velocity. Furthermore, when the acoustic resistance 216 and the additional volume 214 are chosen properly, diversion of the driver volume velocity occurs only at peak response frequencies of the system of the acoustic output through the exit element 202 to the outside environment. This reduces the Q of the output peaks while preserving the output at the valley frequencies; a desirable characteristic.

Figure 6:
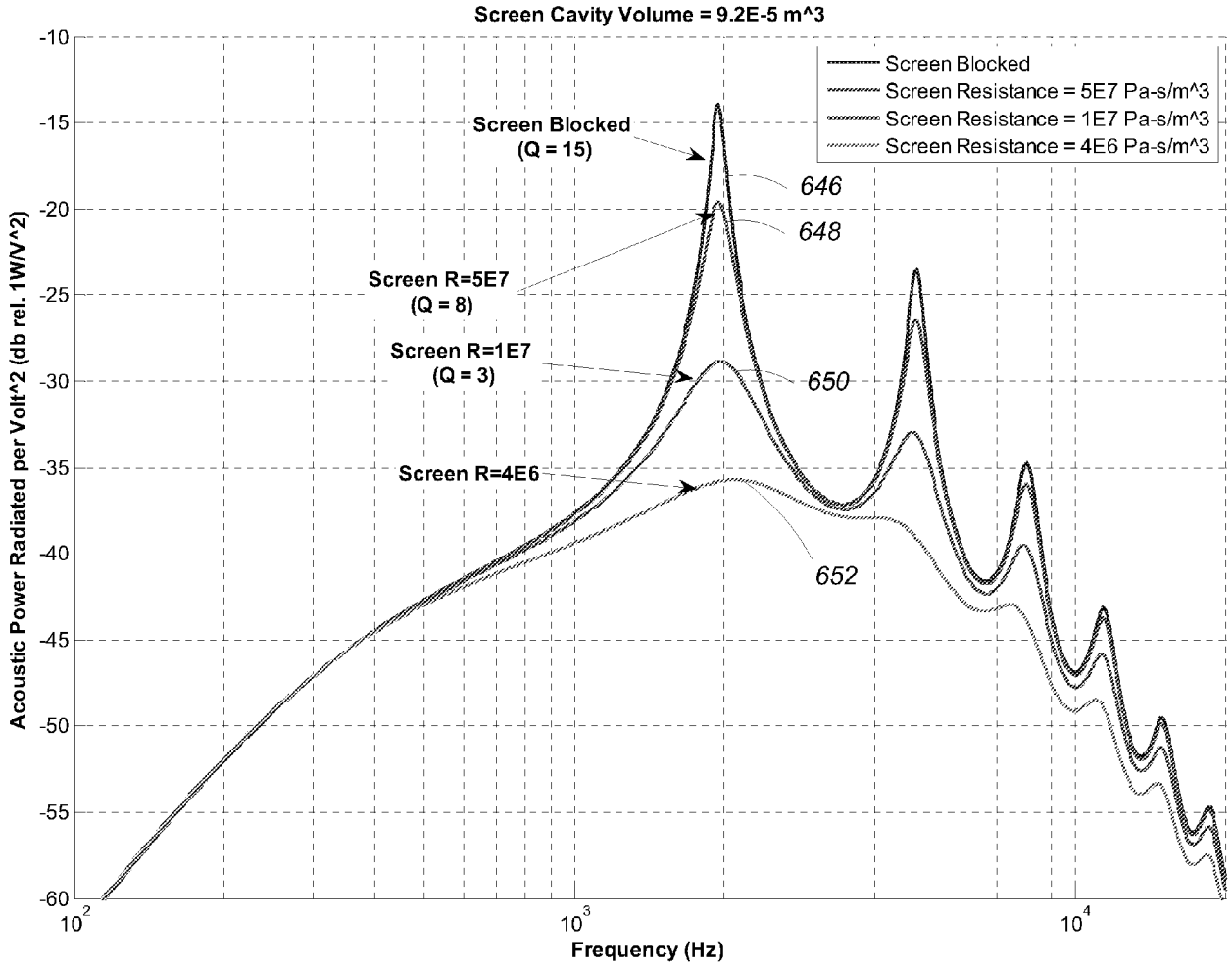
FIG. 6 is a plot of acoustic power radiated sensitivity of the loudspeaker assembly of FIG. 2 with a large additional volume as acoustic resistance is varied.
Figure 7:
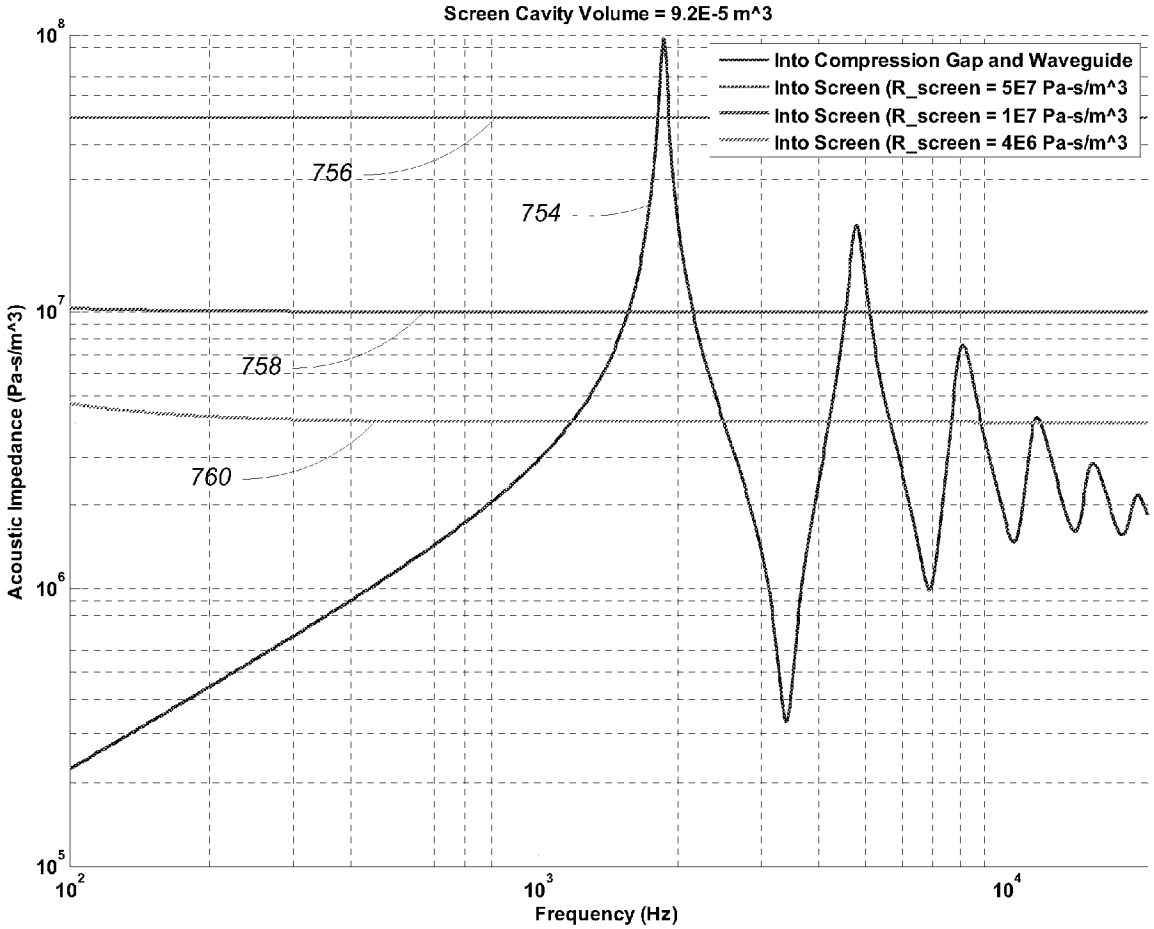
FIG. 7 is a plot of acoustic impedance of the loudspeaker assembly of FIG. 2 with a large additional volume as acoustic resistance is varied.

FIGS. 6 and 7 illustrate the results of an experiment where the volume of the additional volume 214 of a loudspeaker assembly 200 is kept at a constant $9.27e^{-5}$ $m^3$ (i.e., 100 times that of the additional volume in the experiment of FIGS. 4 and 5) and the acoustic resistance 216 of the loudspeaker assembly 200 is varied.

Referring to FIG. 6, a graph illustrates the acoustic power radiated sensitivity of the loudspeaker assembly 200 as the acoustic resistance 216 is varied. The curves on the graph correspond to four different values of the acoustic resistance 216. The first curve 646 corresponds to a configuration of loudspeaker assembly 200 where the resistance of the acoustic resistance 216 is large enough to block any significant movement of air from the compression cavity 204 into the additional volume 214. In this curve 646, strong peaks with a high Q are present at a fundamental resonant frequency and the overtones of the resonant frequency. Valleys in the curve exist at frequencies between the peaks.

The second curve 648 corresponds to a configuration of the loudspeaker assembly 200 where the resistance of the acoustic resistance 216 is:

$5e^7$ Pa·s/m$^3$.

Since this is a relatively high resistance, the Q of each of the peaks shown in the first curve 646 is only slightly reduced.

The third curve 650 corresponds to a configuration of the loudspeaker assembly 200 where the resistance of the acoustic resistance 216 is:

$1e^7$ Pa·s/m$^3$

This resistance sufficiently reduces the Q of each of the peaks shown in the first curve 646 while only minimally reducing the output at the frequencies where valleys exist.

The fourth curve 652 corresponds to a configuration of the loudspeaker assembly 200 where the resistance of the acoustic resistance 216 is:

$4e^6$ Pa·s/m$^3$

While this resistance does reduce the Q of each of the peaks shown in the first curve, it does so at the cost of severely reducing the output at the valley frequencies.

Referring to FIG. 7, a graph illustrates the acoustic impedances of the screen system as the resistance of the acoustic resistance 216 is varied. The first curve 754 on the graph represents the acoustic impedance that is imparted by the compression cavity 204 and the exit element 202. The second curve 756 represents the acoustic impedance imparted by an acoustic resistance 216 with a resistance of:

$5e^7$ Pa·s/m$^3$.

The third curve 758 represents the acoustic impedance imparted by an acoustic resistance 216 with a resistance of:

$1e^7$ Pa·s/m$^3$ and with a volume behind the screen of $9.2\times10^{-5}$ m$^3$.

The fourth curve 760 represents the acoustic impedance imparted by an acoustic resistance 216 with a resistance of:

$4e^6$ Pa·s/m$^3$ and with a volume behind the screen of $9.2\times10^{-5}$ m$^3$.

As was the case in FIG. 5, it can be seen that, in general, when the acoustic impedance imparted by the screen system is dominated by resistance and is large relative to the impedance imparted by the compression cavity 204 and the exit element 202, the screen system has negligible impact on the output or performance of the loudspeaker assembly 200. Additionally, when the acoustic impedance imparted by the screen system is small relative to the impedance imparted by the compression cavity 204 and the exit element 202, the screen system diverts too much driver volume velocity.

However, when the acoustic impedance imparted by the screen system is not large or very small relative to the acoustic impedance imparted by the compression cavity 204 and the exit element 202, the screen system diverts a sufficient amount of the driver volume velocity. Furthermore, when the screen resistance 216 and the additional volume 214 are chosen properly, diversion of the driver volume velocity occurs only at peak response frequencies of the acoustic output. This reduces the Q of the output peaks while preserving the output at the valley frequencies.

Figure 8:
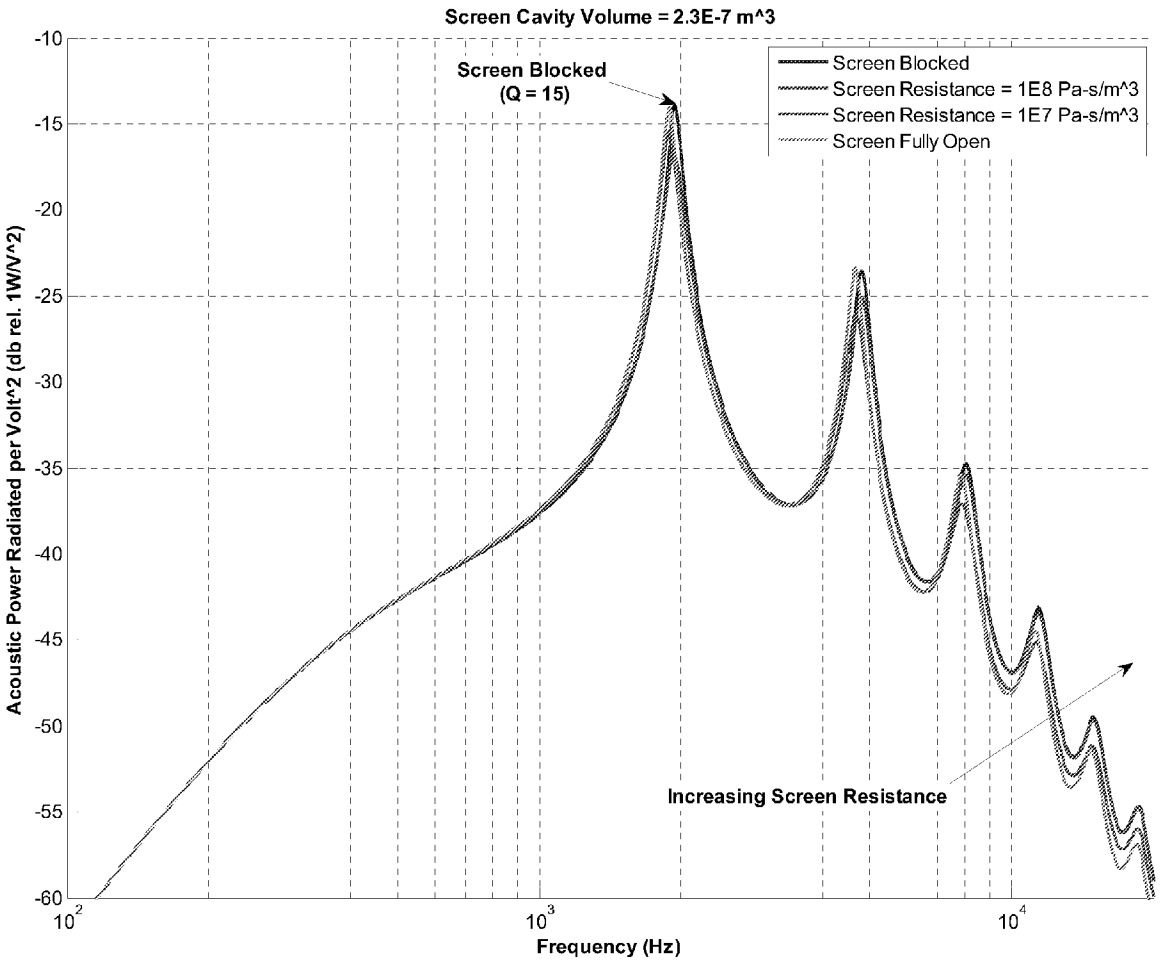
FIG. 8 is a plot of acoustic power radiated sensitivity of the loudspeaker assembly of FIG. 2 with a small additional volume as acoustic resistance is varied.

Referring to FIG. 8, a graph illustrates the acoustic power radiated sensitivity of a loudspeaker assembly 200 when the additional volume 214 is kept at a constant $2.3e^{-7}$ m$^3$ and the acoustic resistance of the loudspeaker assembly 200 is varied.

The additional volume 214 is roughly ¼ the volume that is practical (i.e., the additional volume 214 is too small). As can be seen in the figure, due to the small volume, no matter what the resistance of the acoustic resistance 216, its effect on the Q of the peaks is negligible.

Figure 9:
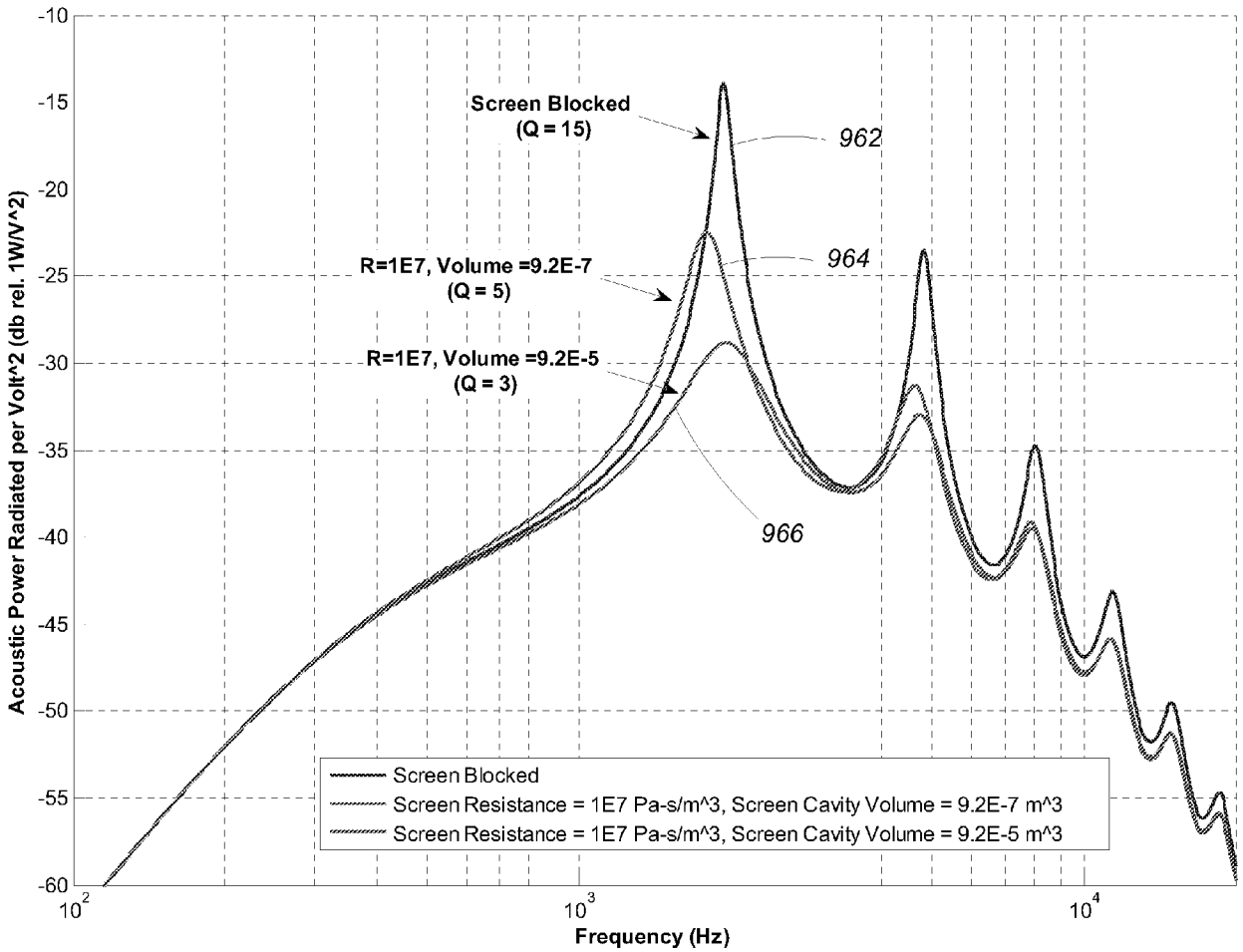
FIG. 9 is a plot of acoustic power radiated sensitivity of the loudspeaker assembly of FIG. 2 as a small additional volume is varied.

Referring to FIG. 9, a plot compares the acoustic power radiated sensitivity of a loudspeaker assembly 200 with no additional volume, a loudspeaker assembly 200 with an additional volume 214 of $9.2e^{-7}$ m$^3$ (i.e., a practically sized volume), and a loudspeaker assembly 200 with an additional volume 214 of $9.2e^{-5}$ m$^3$ (i.e., an impractically large volume). The resistance of the acoustic resistance 216 is held at a constant $1e^7$ Pa·s/m$^3$ in all cases.

As can be seen in the figure, the impractically large volume reduces the Q of the first two peaks when an acoustic resistance 216 is used. However, at the valley frequencies, all three curves are with approximately 1 dB of each other. However, it is noted that impractically large volumes can undesirably increase the size of the loudspeaker assembly.

Alternative Impedance Compensation Elements

In general, impedance compensation elements such as the screen and volume impedance compensation element described above tap into the compression cavity of a loudspeaker assembly at the edge of the compression driver and are coupled to the region in front of the compression driver through a resistive element. A number of loudspeaker elements including alternative embodiments of impedance compensation elements are described below.

Screen, Volume, and Passive Radiator Impedance Compensation Element

Figure 10:
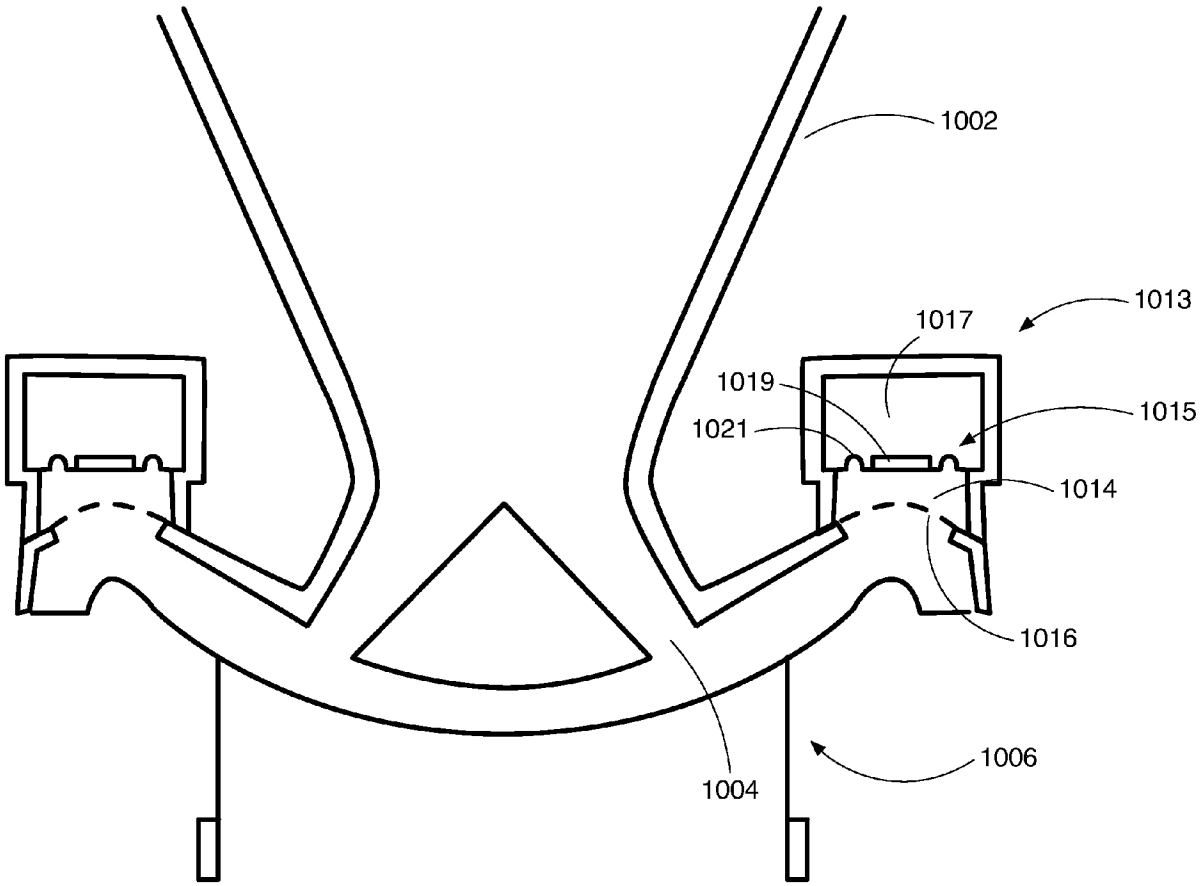
FIG. 10 is a cross sectional view of a compression loudspeaker assembly including a second impedance compensation element.

Referring to FIG. 10, another embodiment of a loudspeaker assembly 1000 is configured to mitigate undesirable frequency response characteristics in a similar manner to the loudspeaker assembly 200 of FIG. 2 but includes an alternative version of the impedance compensation element 1013.

The impedance compensation element 1013 includes a passive radiator 1015 and an acoustic resistance 1016. The acoustic resistance 1016 is located near the outer edge of the driver element 1006 and lies between a compression cavity 1004 and a first additional volume 1014. A second additional volume 1017 is separated from the first additional volume 1014 by the passive radiator 1015.

The impedance compensation element 1013 is designed to have an acoustic impedance which is dominated by resistance and is low relative to the impedance of the exit element 1002 at a specified frequency, ω, where acoustic radiation from the exit element 1002 has a high Q response. In some examples, to achieve the low acoustic impedance, the passive radiator 1015 includes a mass 1019 which is suspended from an inner wall of one of the cavities 1014, 1012 by a spring-like "half-roll" surround 1021. The mass 1019 and surround 1021 act like a spring-mass system which can be designed to resonate at the frequency, ω. The resonant frequency of the passive radiator 1015 depends on the mass 1019, the compliance of the passive radiator surround, the compliance of the air in the first additional volume 1014, the compliance of the air in the second additional volume 1017, and the resistance imparted by the acoustic resistance 1016 which acts to damp the resonance of the passive radiator 1015. Thus, the resonant frequency, ω, of the impedance compensation element 1013 can be tuned to a desired frequency by altering the mass 1019, the size of the additional volumes 1014, 1017, and/or the acoustic resistance 1016.

In operation, at the resonant frequency, ω, the passive radiator 1015 provides a very low impedance which is dominated by resistance, effectively causing absorption of acoustic energy by the impedance compensation element 1013 rather than having the acoustic energy radiate from the exit element 1002. The damping effect of the acoustic resistance 1016 serves to increase the overall acoustic impedance of the impedance compensation element 1013 at the resonant frequency of the passive radiator system, thereby preventing all of the acoustic energy at the resonant frequency, ω, from being absorbed by the impedance compensation element 1013. The resulting impedance compensation element 1013 has a high acoustic impedance at all frequencies except for the resonant frequency, ω, where it is designed to operate.

In some examples, multiple passive radiators 1015 of the type described above can be included in impedance compensation element 1013, resulting in multiple impedance minimums at different frequencies.

Figure 11:
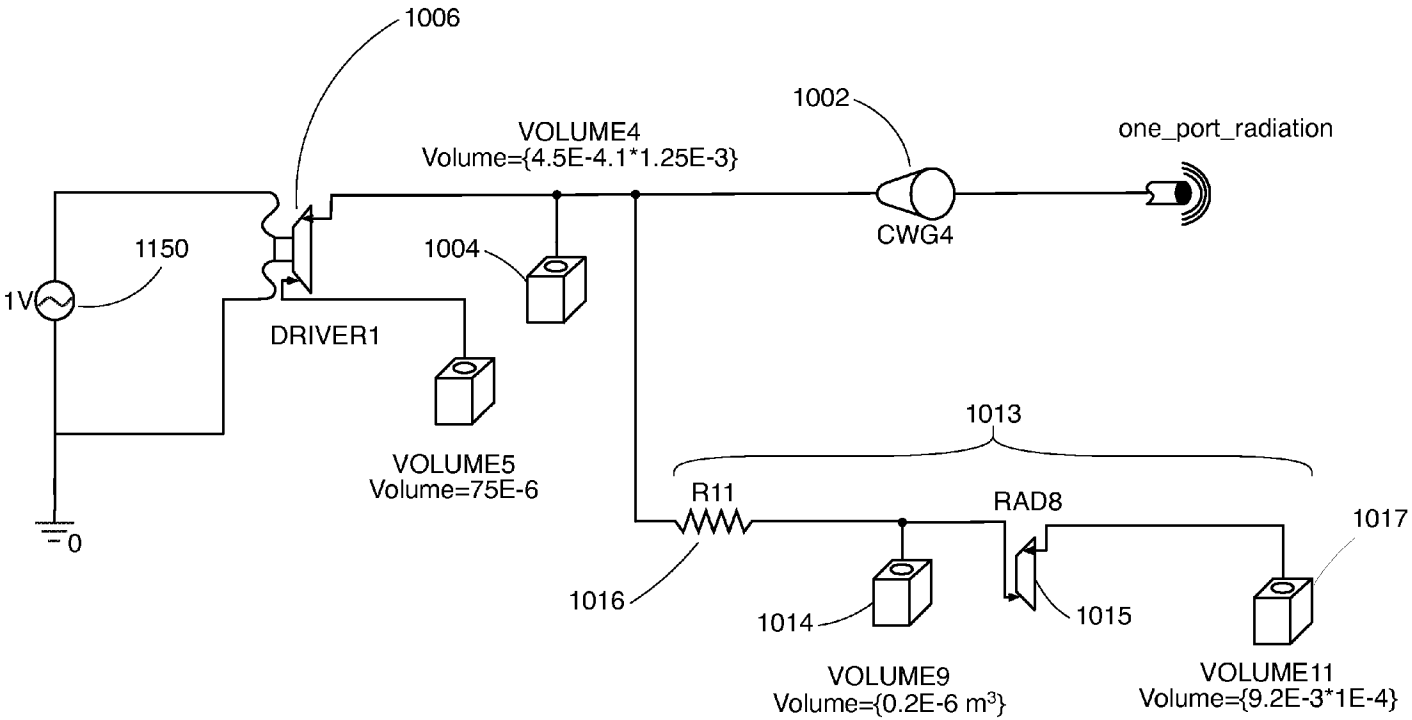
FIG. 11 is a simulation diagram of the loudspeaker assembly of FIG. 10.

Referring to FIG. 11, a simulation diagram 1100 abstractly illustrates the arrangement of the components of the loudspeaker assembly 1000 of FIG. 10, along with exemplary values for volumes, areas, etc. of the components. In operation, an electrical signal from a signal source 1150 is applied to the loudspeaker element 1006 which transduces the electrical signal into sound waves. The sound waves propagate into the compression cavity 1004 from which a first portion of the sound waves propagates into the exit element 1002 and a second portion of the sound waves propagates into the impedance compensation element 1013. The content of the first and second portions of the sound waves depends on the frequency content of the transduced sound waves, the acoustic impedance presented by the acoustic exit element 1002, and the acoustic impedance presented by the impedance compensation element 1013.

The first portion of the sound waves propagates through the exit element 1002 and into the outside environment. The second portion of the sound waves propagates through the acoustic resistance 1016 which separates the compression cavity 1004 from the first additional volume 1014, and into the first additional volume 1014. In the first additional volume 1014 the second portion of the sound waves encounters a passive radiator 1015 which separates the first additional volume 1014 from the second additional volume 1017. The second additional volume 1017 and passive radiator 1015 are configured such that any sound waves at a frequency, ω, cause the passive radiator 1015 to oscillates a the frequency, ω, damping acoustic energy at that frequency.

Figure 12:
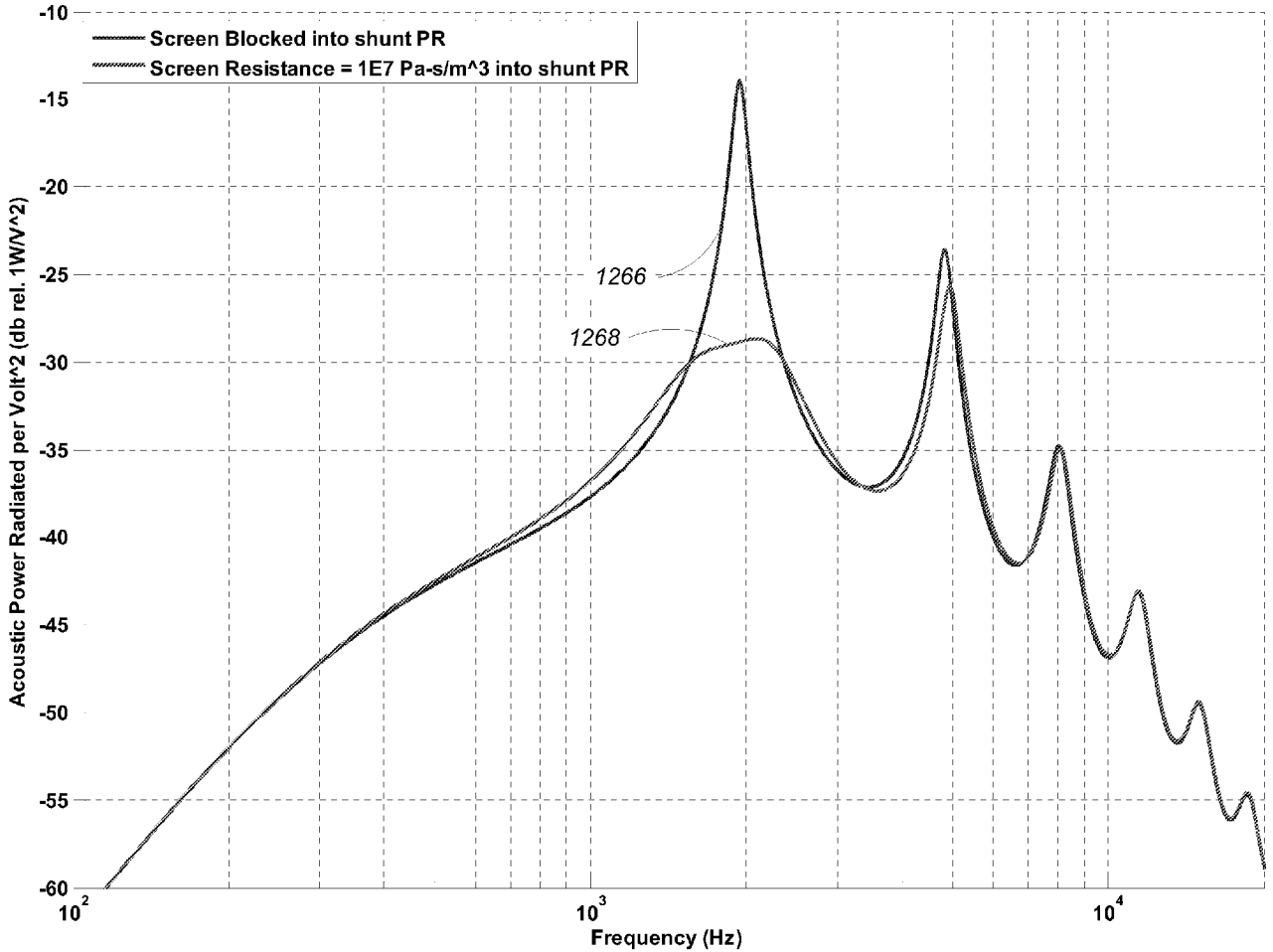
FIG. 12 is a plot of acoustic power radiated sensitivity of the loudspeaker assembly of FIG. 10.

FIG. 12 is a graph of the acoustic power radiated sensitivity of the loudspeaker assembly 1000 both with and without the impedance compensation element 1013 in place. In particular a first curve 1266 on the graph represents the acoustic power radiated sensitivity of the loudspeaker assembly 1000 without the impedance compensation element 1013 in place. In this curve 1266, strong peaks with a high Q are present at a fundamental resonant frequency and overtones of the resonant frequency. Valleys in the curve 1266 exist at frequencies between the peaks.

A second curve 1268 on the graph represents the acoustic power radiated sensitivity of the loudspeaker assembly 1000 including the impedance compensation element 1013 which is designed to reduce the Q of the peak at the fundamental resonant frequency. The impedance compensation element 1013 reduces the Q of the fundamental resonant frequency peak shown in the first curve 1266 while only minimally reducing the output at frequencies other than the fundamental resonant frequency.

Figure 13:
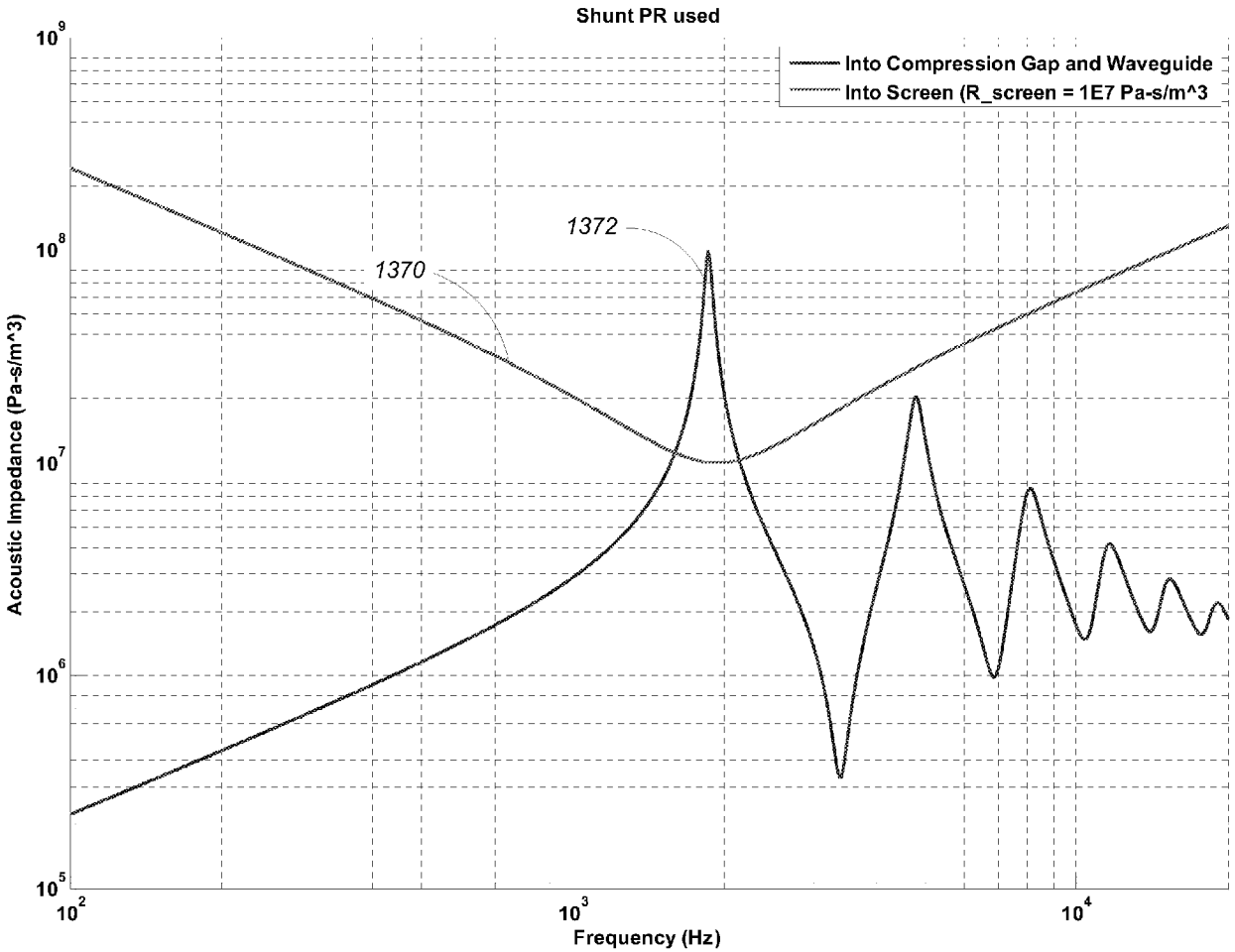
FIG. 13 is a plot of acoustic impedance of the loudspeaker assembly of FIG. 10.

FIG. 13 is a graph which illustrates the acoustic impedance imparted by different components of the loudspeaker assembly 1000. A first curve 1370 on the graph represents the acoustic impedance contributed by the impedance compensation element 1013. A second curve 1372 on the graph represents the acoustic impedance contributed by the cavity 1004 and waveguide 1002. As can be seen by inspection of the graph, the peak at the fundamental resonant frequency in the second curve 1372 is aligned with the lowest impedance represented in the first curve 1370. Thus, much of the acoustic power present in the loudspeaker assembly 1000 radiates into the impedance compensation element 1013 at frequencies where the acoustic impedance imparted by the impedance compensation element 1013 (illustrated by first curve 1370) is low relative to the acoustic impedance imparted by the cavity 1004 and waveguide 1002 (illustrated by second curve 1372).

Screen and Tapered Shunt Impedance Compensation Element

Figure 14:
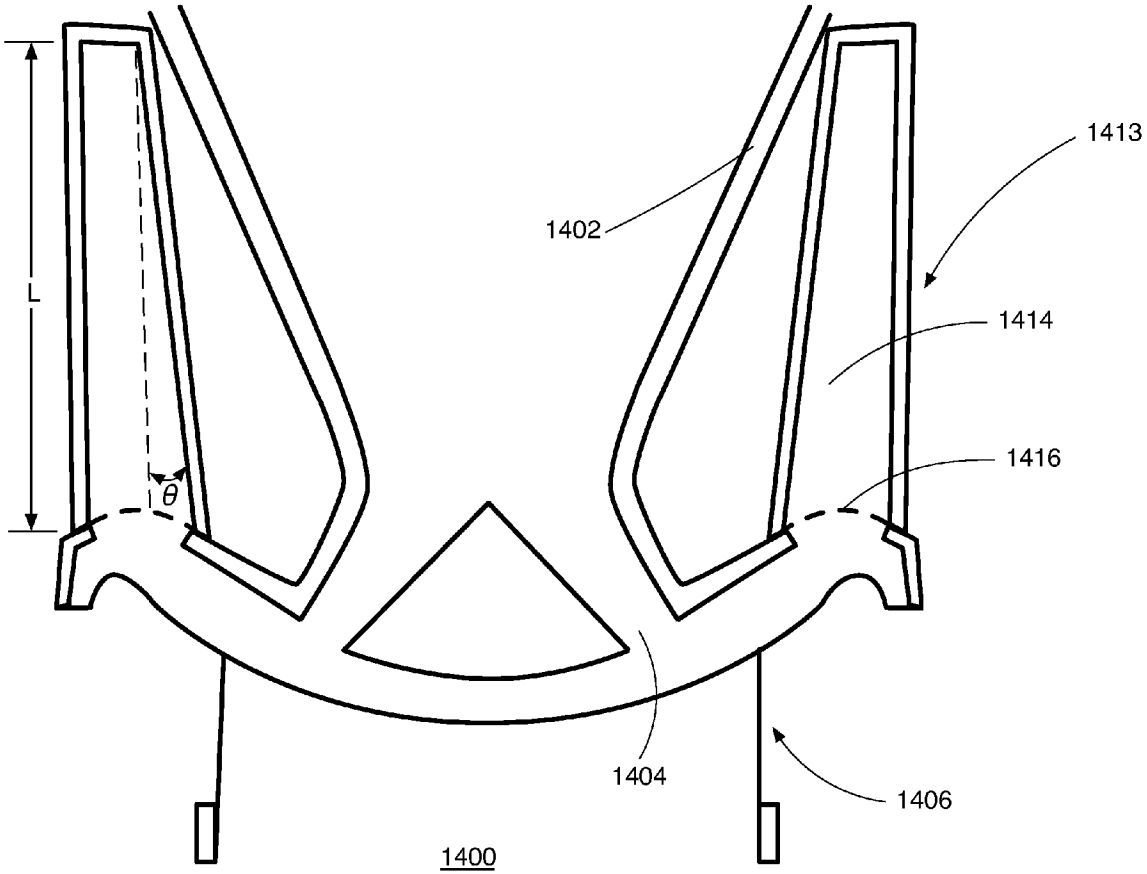
FIG. 14 is a cross sectional view of a compression loudspeaker assembly including a third impedance compensation element.

Referring to FIG. 14, another embodiment of a loudspeaker assembly 1400 is configured to mitigate undesirable frequency characteristics in a similar manner to the loudspeaker assembly 200 of FIG. 2 but includes an alternative version of the impedance compensation element 1413. The impedance compensation element 1413 includes an acoustic resistance 1416 located near an outer edge of the driver element 1006 and between an additional volume 1414 and a compression cavity 1404. The additional volume 1414 is an elongated and in some examples, tapered additional axisymmetric volume 1414. The acoustic resistance 1416 acts to increase the overall impedance imparted by the additional volume 1414.

The impedance compensation element 1413 can be configured to have a low acoustic impedance relative to the acoustic impedance of the exit element 1402 and cavity 1404 at a number frequencies, $\omega_1, \omega_2, \ldots \omega_N$. In particular, if the length, L, of the additional volume 1414 is long enough, the additional volume 1414 no longer acts as a compliant volume, but instead acts as a waveguide. The number and location of the resonances of the additional volume 1414 can be configured by adjusting the length, L, and/or the angle of taper, θ, of the additional volume 1414. Adjusting the length, L, of the additional volume 1414 causes the location of the fundamental resonant frequency of the additional volume 1414 to move. Adjusting the angle of taper, θ, of the additional volume 1414 causes the location and spacing of the resonant overtones to change. For example, if θ=θ°, the resonant overtones are harmonically spaced from the fundamental resonance. Other values of θ result in non-harmonic spacing of the resonant overtones. The acoustic resistance 1416 serves to increase the overall acoustic impedance of the impedance compensation element 1413, thereby preventing all of the acoustic energy at the resonant frequencies, $\omega_1, \omega_2, \ldots \omega_N$, from being absorbed by the impedance compensation element 1413. The resulting impedance compensation element 1413 has a high acoustic impedance at all frequencies except for the resonant frequencies, $\omega_1, \omega_2, \ldots \omega_N$, where it is designed to operate.

Figure 15:
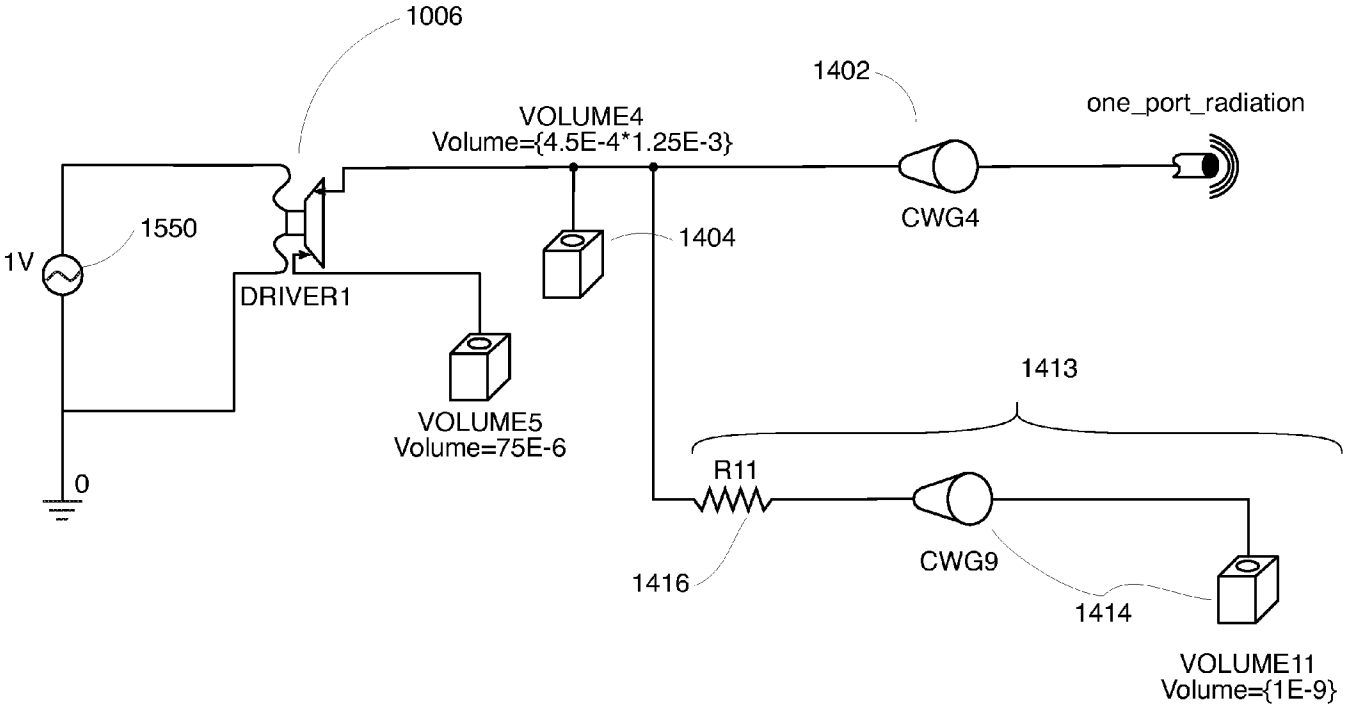
FIG. 15 is a simulation diagram of the loudspeaker assembly of FIG. 14.

Referring to FIG. 15, a simulation diagram 1500 abstractly illustrates the arrangement of the components of the loudspeaker assembly 1400 of FIG. 14, along with exemplary values for volumes, areas, etc. of the components. In operation, an electrical signal from a signal source 1550 is applied to the loudspeaker element 1006 which transduces the electrical signal into sound waves. The sound waves propagate into the compression cavity 1404 from which a first portion of the sound waves propagates into the exit element 1402 and a second portion of the sound waves propagates into the impedance compensation element 1413. The content of the first and second portions of the sound waves depends on the frequency content of the transduced sound waves, the acoustic impedance presented by the acoustic exit element 1402, and the acoustic impedance presented by the impedance compensation element 1413.

The first portion of the sound waves propagates through the exit element 1402 and into the outside environment. The second portion of the sound waves propagates through the acoustic resistance 1416 which separates the compression cavity 1004 from the additional volume 1014, and into the additional volume 1014. Note that since the additional volume 1414 is tapered as is described above, the simulation diagram 1500 represents the additional volume 1414 as a tapered waveguide which radiates into a very small volume (i.e., a cap at the end of the tapered waveguide). As is described above, the additional volume 1414 has a length, L, and an angle of taper, θ, which are configurable such that the additional volume 1414 resonates at a desired set of frequencies, thereby damping acoustic energy at those frequencies.

Figure 16:
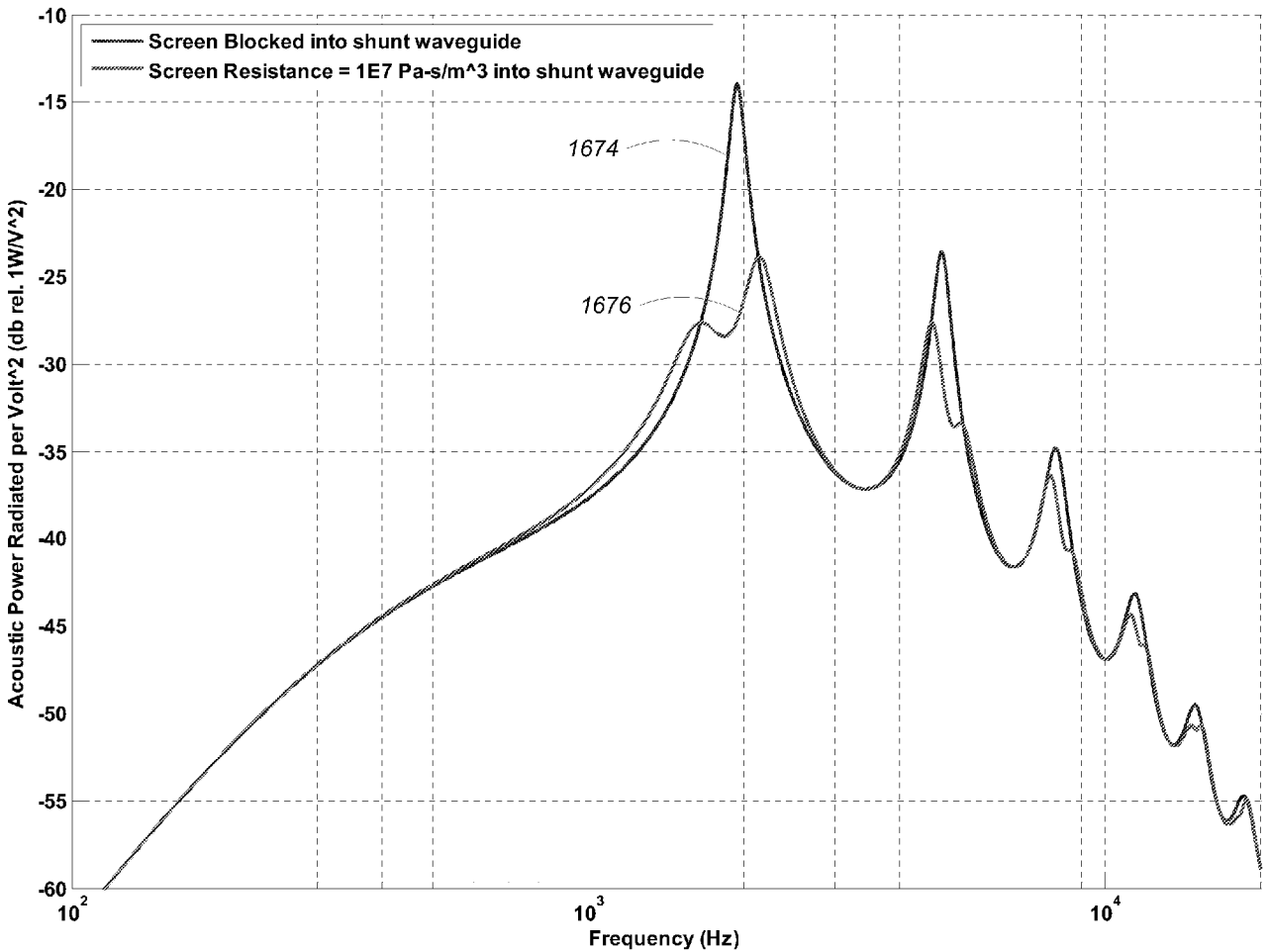
FIG. 16 is a plot of acoustic power radiated sensitivity of the loudspeaker assembly of FIG. 14.

FIG. 16 is a graph of the acoustic power radiated sensitivity of the loudspeaker assembly 1400 both with and without the impedance compensation element 1413 in place. In particular a first curve 1674 on the graph represents the acoustic power radiated sensitivity of the loudspeaker assembly 1400 without the impedance compensation element 1413 in place. In the first curve 1474, strong peaks with a high Q are present at a fundamental resonant frequency and overtones of the resonant frequency. Valleys in the curve 1474 exist at frequencies between the peaks.

A second curve 1676 on the graph represents the acoustic power radiated sensitivity of the loudspeaker assembly 1400 including the impedance compensation element 1413 which is designed to reduce the Q of the peaks of the fundamental resonant frequency as well as the peaks of the resonant overtone frequencies. The impedance compensation element 1413 reduces the Q of the peaks of both the fundamental resonant frequency and the resonant overtone frequencies. Reducing the Q of the peaks of both the fundamental resonant frequency and the resonant overtone frequencies can be a desirable characteristic when the exit element 1402 produces multiple resonances with high Q values.

Figure 17:
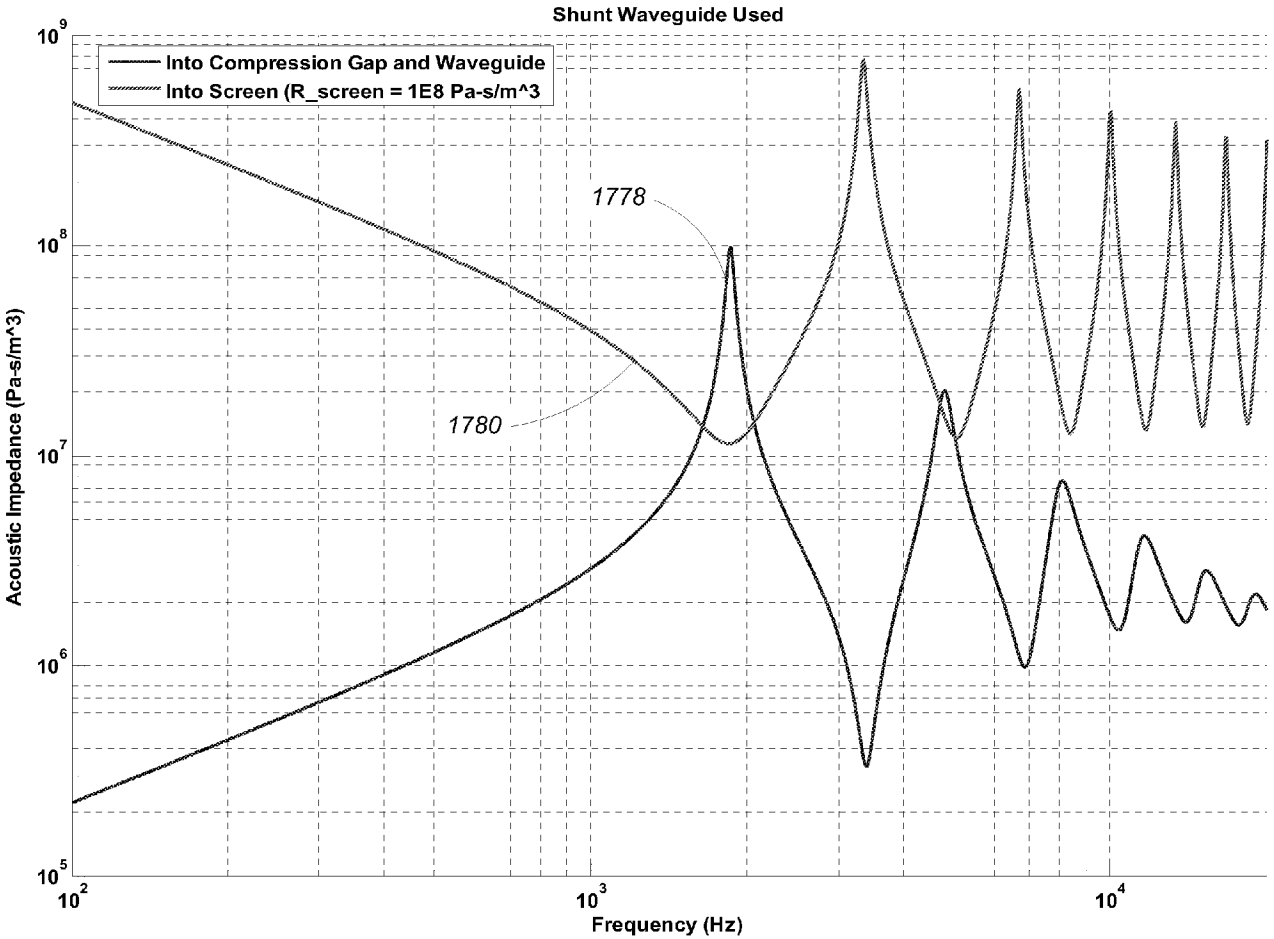
FIG. 17 is a plot of acoustic impedance of the loudspeaker assembly of FIG. 14.

FIG. 17 is a graph which illustrates the acoustic impedance imparted by different components of the loudspeaker assembly 1400. A first curve 1778 on the graph represents the acoustic impedance imparted by the impedance compensation element 1413. A second curve 1780 on the graph represents the acoustic impedance imparted by the cavity 1404 and waveguide 1402. As can be seen by inspection of the graph, the peaks in the second curve 1780 are aligned with the notches in the first curve 1778. Thus, much of the acoustic power present in the loudspeaker assembly 1400 radiates into the impedance compensation element 1413 at the resonant frequencies where the acoustic impedance imparted by the impedance compensation element 1413 is low.

Volume and Passive Radiator Impedance Compensation Element

Figure 18:
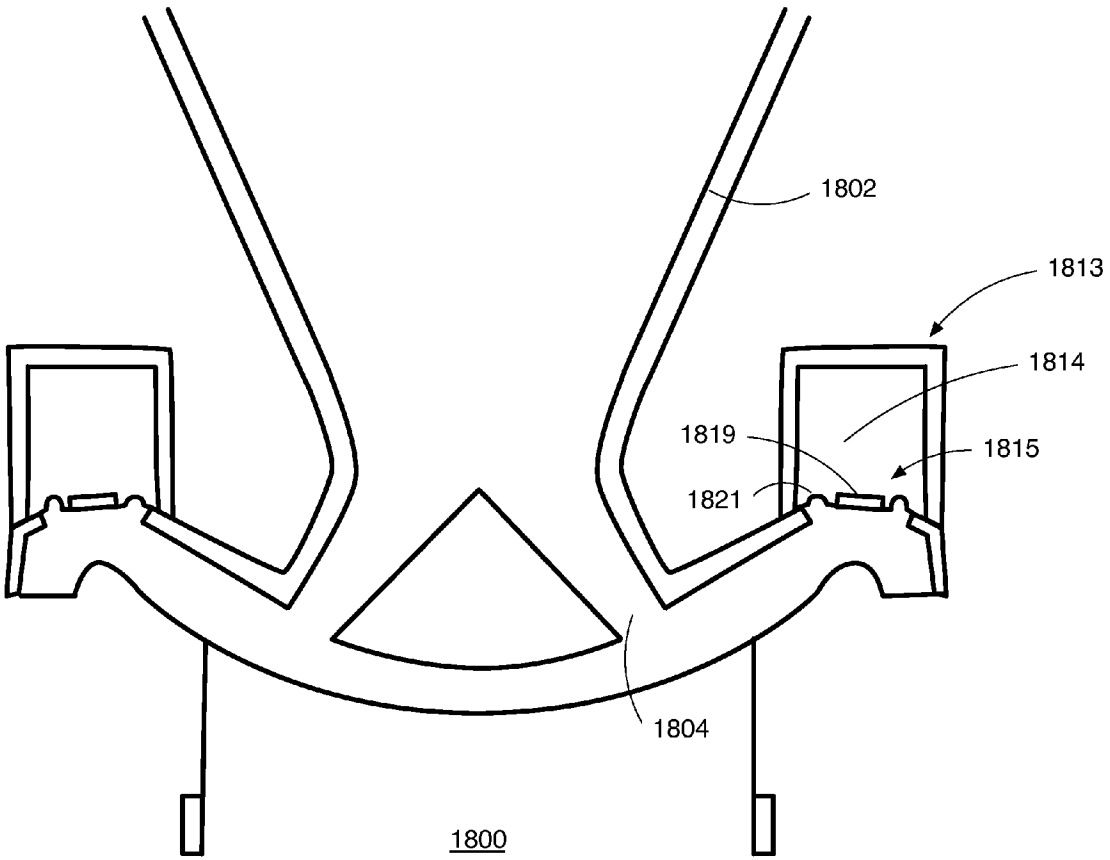
FIG. 18 is a cross sectional view of a compression loudspeaker assembly including a fourth impedance compensation element.

Referring to FIG. 18, another embodiment of a loudspeaker assembly 1800 is configured to mitigate undesirable frequency response characteristics in a similar manner to the loudspeaker assembly 200 of FIG. 2 but includes an alternative version of the impedance compensation element 1813. The alternative version of the impedance compensation element 1813 is designed to have a low acoustic impedance relative to the acoustic impedance of the exit element 1802 at a specified frequency, ω, where acoustic radiation has a high Q response.

The impedance compensation element 1813 includes a passive radiator 1815 which separates an additional axisymmetric volume 1814 from a compression cavity 1804. In some examples, the passive radiator 1815 includes a mass 1819 which is suspended from an inner wall of the additional volume 1814 by a spring-like surround 1821. The mass 1819 and surround 1821 act like a spring-mass system and are capable of resonating at a frequency, ω. In this embodiment, rather than including an acoustic resistance as in previous embodiments, the surround 1821 of the passive radiator 1815 is a high loss surround 1821 which serves to dampen the oscillations of the passive radiator 1815. Thus, the value of ω depends on the mass 1819, the loss provided by the surround 1821 and the compliance of the air in the additional volume 1814. The resonant frequency, ω, of the impedance compensation element 1813 can be tuned to a desired frequency by altering the mass 1819, the characteristics of the surround 1821, and/or the size of the additional volume 1014.

In operation, at the resonant frequency, ω, the passive radiator 1815 provides a low impedance, effectively causing absorption of acoustic energy by the impedance compensation element 1813 rather than having the acoustic energy radiate from the exit element 1802. The high loss surround 1821 of the passive radiator 1815 serves to increase the overall acoustic impedance of the impedance compensation element 1813, thereby preventing all of the acoustic energy at the resonant frequency, ω from being absorbed by the impedance compensation element 1813. The resulting impedance compensation element 1813 has a high acoustic impedance at all frequencies except for the resonant frequency, ω, where it is designed to operate.

In some examples, multiple passive radiators 1815 of the type described above can be included in the impedance compensation element 1813, resulting in multiple impedance minimums at different frequencies. In some examples, the passive radiator is a membrane made of a high loss elastomer.

Ported Volume and Screen Impedance Compensation Element

Figure 19:
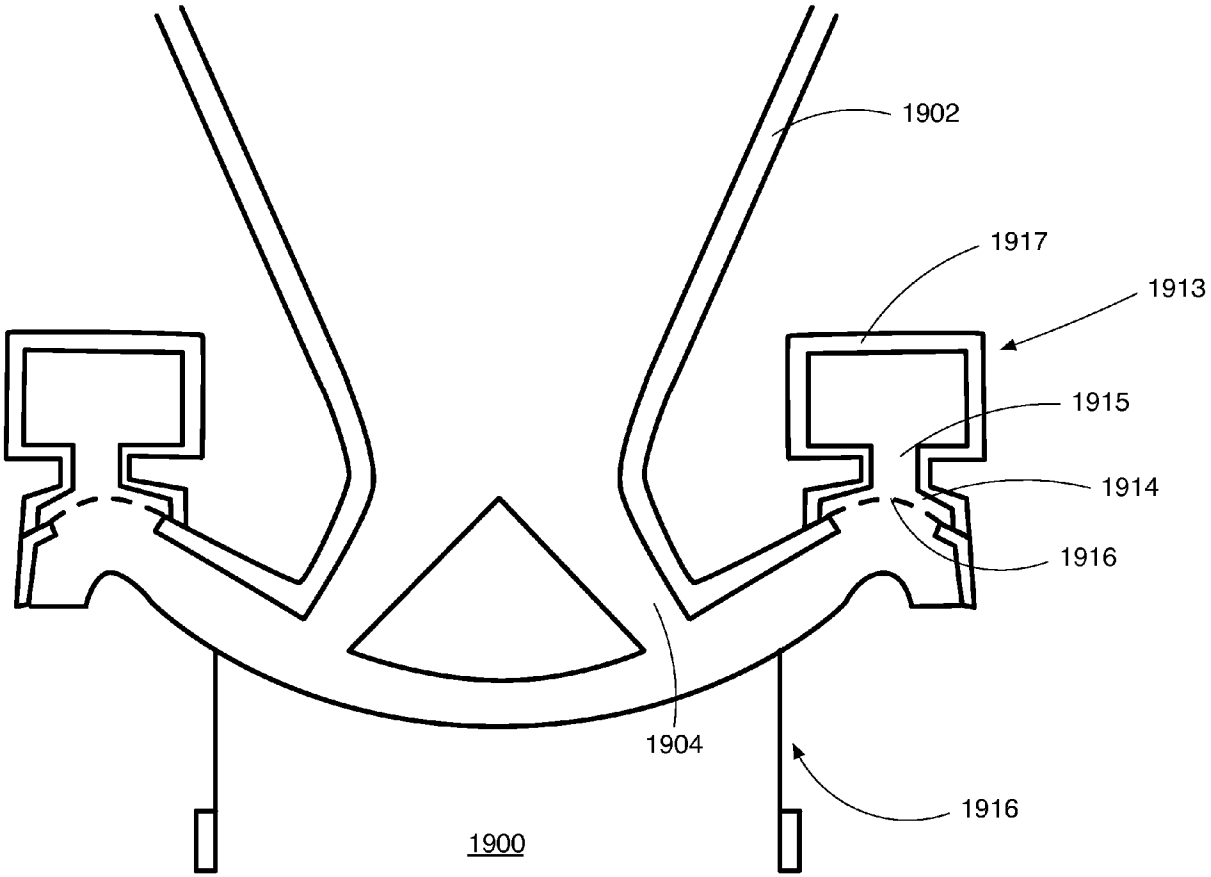
FIG. 19 is a cross sectional view of a compression loudspeaker assembly including a fifth impedance compensation element.

Referring to FIG. 19, another embodiment of a loudspeaker assembly 1900 is configured to mitigate undesirable frequency response characteristics in a similar manner to the loudspeaker assembly 200 of FIG. 2 but includes an alternative version of the impedance compensation element

1913. The alternative version of the impedance compensation element 1913 is designed to have a low acoustic impedance relative to the acoustic impedance of the exit element 1902 at a specified frequency, ω, where acoustic radiation has a high Q response.

The impedance compensation element 1913 includes an acoustic resistance 1916 located near the outer edge of the driver element 1906, and separating the compression cavity 1904 from a first additional volume 1914. A port element 1915 separates a second additional volume 1917 from the first additional volume 1914. Such a configuration is essentially an approximation of using a passive radiator, where the port element 1915 has a similar effect to the mass of a passive radiator.

In some examples, the value of ω depends on the port 1915, the compliance of the air in the first additional volume 1914, the compliance of the air in the second additional volume 1917, and the resistance imparted by the acoustic resistance 1916. Thus, the resonant frequency, ω, of the impedance compensation element 1913 can be tuned to a desired frequency by altering the port element size 1915, the size of the additional volumes 1914, 1917, and/or the acoustic resistance 1916.

In operation, at the resonant frequency, ω, the impedance compensation element 1913 provides a low impedance, effectively causing absorption of acoustic energy by the impedance compensation element 1913 rather than having the acoustic energy radiate from the exit element 1902. The acoustic resistance 1916 serves to increase the overall acoustic impedance of the impedance compensation element 1913, thereby preventing all of the acoustic energy at the resonant frequency, ω, from being absorbed by the impedance compensation element 1913. The resulting impedance compensation element 1913 has a high acoustic impedance at all frequencies except for the resonant frequency, ω, where it is designed to operate.

In some examples, additional port elements and volumes can be added and chained together to produce multiple impedance minimums at different frequencies. For example, the additional ports and volumes can be configured such that they align with high Q resonances of the waveguide 1902 and compression cavity 1904.

In some examples, the port elements act as a resistive element between two cavities.

It is to be understood that the foregoing description is intended to illustrate and not to limit the scope of the invention, which is defined by the scope of the appended claims. Other embodiments are within the scope of the following claims.

What is claimed is:

1. A loudspeaker comprising: an enclosure; a driver element located within the enclosure and comprising a cone diaphragm; a first cavity, defined by a first cavity wall and the cone diaphragm, the first cavity extending from the cone diaphragm and having a first opening which has an area less than an area of the cone diaphragm; an exit element extending from the first opening of the first cavity and acoustically coupling the first cavity to an environment outside of the enclosure; a second cavity, defined by a second cavity wall within the enclosure extending from a second opening in the first cavity; an acoustic element in the second opening acoustically coupling the second cavity to the first cavity, the second cavity not otherwise being acoustically coupled to the environment outside of the enclosure; wherein the first cavity and the exit element in combination have a first acoustic impedance, and resonances occur in the first cavity at first frequencies; the second cavity and the acoustic element together have a second acoustic impedance; at the first frequencies, the second acoustic impedance is dominated by resistance and is less than the first acoustic impedance; and at frequencies other than the first frequencies, where resonances do not occur in the first cavity, the second acoustic impedance is greater than the first acoustic impedance.

2. The loudspeaker of claim 1 wherein the second opening in the first cavity is at a location in the first cavity which is in close proximity to the cone diaphragm.

3. The loudspeaker of claim 1 wherein the acoustic element comprises an acoustic resistance element in the form of a screen material.

4. The loudspeaker of claim 1 wherein the acoustic element comprises an acoustic resistance element in the form of a foam material.

5. A loudspeaker comprising: an enclosure; a driver element located within the enclosure and comprising a cone diaphragm; a first cavity, defined by a first cavity wall and the cone diaphragm, the first cavity extending from the cone diaphragm and having a first opening which has an area less than an area of the cone diaphragm; an exit element extending from the first opening of the first cavity and acoustically coupling the first cavity to an environment outside of the enclosure; a second cavity, defined by a second cavity wall within the enclosure extending from a second opening in the first cavity; an acoustic element in the second opening acoustically coupling the second cavity to the first cavity, the second cavity not otherwise being acoustically coupled to the environment outside of the enclosure; wherein acoustic radiation from the exit element has a high Q response at a frequency ω; the second cavity and the acoustic element form a resonating compensation element having a resonant frequency of ω; and wherein the acoustic element comprises a passive radiator filling the second opening in the first cavity, the passive radiator including a high-loss surround which dampens oscillations of the passive radiator.

6. The loudspeaker of claim 5 wherein the resonating compensation element further comprises: a passive radiator dividing a portion of the second cavity to form a third cavity.

7. The loudspeaker of claim 5 wherein the resonating compensation element further comprises: a neck between the second cavity and the first cavity, formed by the second cavity wall, the neck being narrower than the width of the remainder of the second cavity.

8. The loudspeaker of claim 1 further comprising: a plurality of additional cavities formed by additional cavity walls within the enclosure; one or more acoustic resistance elements coupling one or more of the plurality of additional cavities to the first cavity; and a plurality of passive radiator elements coupling at least some of the plurality of additional cavities to each other.

9. The loudspeaker of claim 8 wherein the pluralities of additional cavities and passive radiator elements produce multiple impedance minimums at different frequencies corresponding to high Q resonances of the exit element and first cavity.

10. The loudspeaker of claim 1 further comprising: a plurality of additional cavities formed by additional cavity walls within the enclosure; one or more acoustic resistance elements coupling one or more of the plurality of additional cavities to the first cavity; and a plurality of necks formed by corresponding ones of the additional cavity walls coupling at least some of the plurality of cavities to each other.

11. The loudspeaker of claim 1 wherein the second cavity is elongated.

12. The loudspeaker of claim 11 wherein the second cavity is tapered.

13. The loudspeaker of claim 12 wherein the length of the second cavity causes the cavity to act as a waveguide, and the taper of the second cavity controls the location and spacing of resonant overtones of the second cavity, the length and taper together causing the second cavity and the acoustic element to have low acoustic impedance relative to the acoustic impedance of the exit element and first cavity at a plurality of frequencies $\omega_1, \omega_2, \ldots \omega_N$.

14. The loudspeaker of claim 1 further comprising a phase plug located within the first cavity.

* * * * *